US008750766B2

(12) United States Patent
Sakamoto et al.

(10) Patent No.: US 8,750,766 B2
(45) Date of Patent: Jun. 10, 2014

(54) POWDER CONTAINER AND POWDER PROCESSING APPARATUS HAVING A LID WITH RIB FOR SUPPRESSING INCLINATION

(75) Inventors: Takashi Sakamoto, Kanagawa (JP); Hiroaki Okuma, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 381 days.

(21) Appl. No.: 13/221,168

(22) Filed: Aug. 30, 2011

(65) Prior Publication Data

US 2012/0222776 A1 Sep. 6, 2012

(30) Foreign Application Priority Data

Mar. 4, 2011 (JP) ..... 2011-047696

(51) Int. Cl.
*G03G 15/08* (2006.01)

(52) U.S. Cl.
CPC ..... *G03G 15/0886* (2013.01)
USPC ..... 399/258; 399/260; 399/262

(58) Field of Classification Search
CPC ..... G03G 15/0886; G03G 15/0877; G03G 2215/067; G03G 2215/0692
USPC ..... 399/258, 260, 262
See application file for complete search history.

(56) References Cited

U.S. PATENT DOCUMENTS

| | | | | |
|---|---|---|---|---|
| 7,780,040 | B2 * | 8/2010 | Wegman | 399/262 |
| 8,103,196 | B2 * | 1/2012 | Koshimori et al. | 399/258 |
| 8,483,599 | B2 * | 7/2013 | Okuma et al. | 399/260 |
| 2008/0298835 | A1 | 12/2008 | Takashima | |

* cited by examiner

*Primary Examiner* — William J Royer
(74) *Attorney, Agent, or Firm* — Sughrue Mion, PLLC

(57) ABSTRACT

A powder container includes a container body that can be attached to and detached from a powder processing apparatus and that includes an outer wall having an opening; a lid that covers the opening and that is held by a lid holder such that the opening is not covered by the lid when the container body is attached to the powder processing apparatus; a retaining frame that projects from the periphery of the opening and retains the lid in a movable manner; and a suppressing body that projects from the lid by an amount set such that the suppressing body does not come into contact with the outer wall when the lid is moved and such that, if the lid is inclined while being held, the suppressing body comes into contact with the outer wall to suppress the inclination of the lid before the lid is released.

8 Claims, 27 Drawing Sheets

POWDER CONTAINER AND POWDER PROCESSING APPARATUS HAVING A LID WITH RIB FOR SUPPRESSING INCLINATION

CROSS-REFERENCE TO RELATED APPLICATIONS

This application is based on and claims priority under 35 USC 119 from Japanese Patent Application No. 2011-047696 filed Mar. 4, 2011.

BACKGROUND

The present invention relates to a powder container and a powder processing apparatus including the powder container.

SUMMARY

According to an aspect of the invention, there is provided a powder container including a container body capable of being attached to and detached from a powder processing apparatus that processes powder, the container body including an outer wall that has an opening and extends in an attachment-detachment direction in which the container body is attached or detached, the container body containing the powder before or after the powder is processed; a lid that covers the opening in the outer wall, the lid being held by a lid holder such that the opening is not covered by the lid when the container body is attached to the powder processing apparatus, the lid holder being provided in the powder processing apparatus; a retaining frame that projects from the periphery of the opening in the outer wall so as to extend over an area around the opening, the retaining frame retaining the lid such that the lid is movable in the attachment-detachment direction; and a suppressing body that projects from the lid toward the outer wall of the container body by an amount set such that the suppressing body does not come into contact with the outer wall when the lid is moved and such that, if the lid is inclined while being held by the lid holder, the suppressing body comes into contact with the outer wall to suppress the inclination of the lid before the lid is released from the lid holder.

BRIEF DESCRIPTION OF THE DRAWINGS

An exemplary embodiment of the present invention will be described in detail based on the following figures, wherein.

DETAILED DESCRIPTION

A powder container and a powder processing apparatus according to an exemplary embodiment will be described with reference to the drawings.

Overall Structure of Image Forming Apparatus

Figure 1:
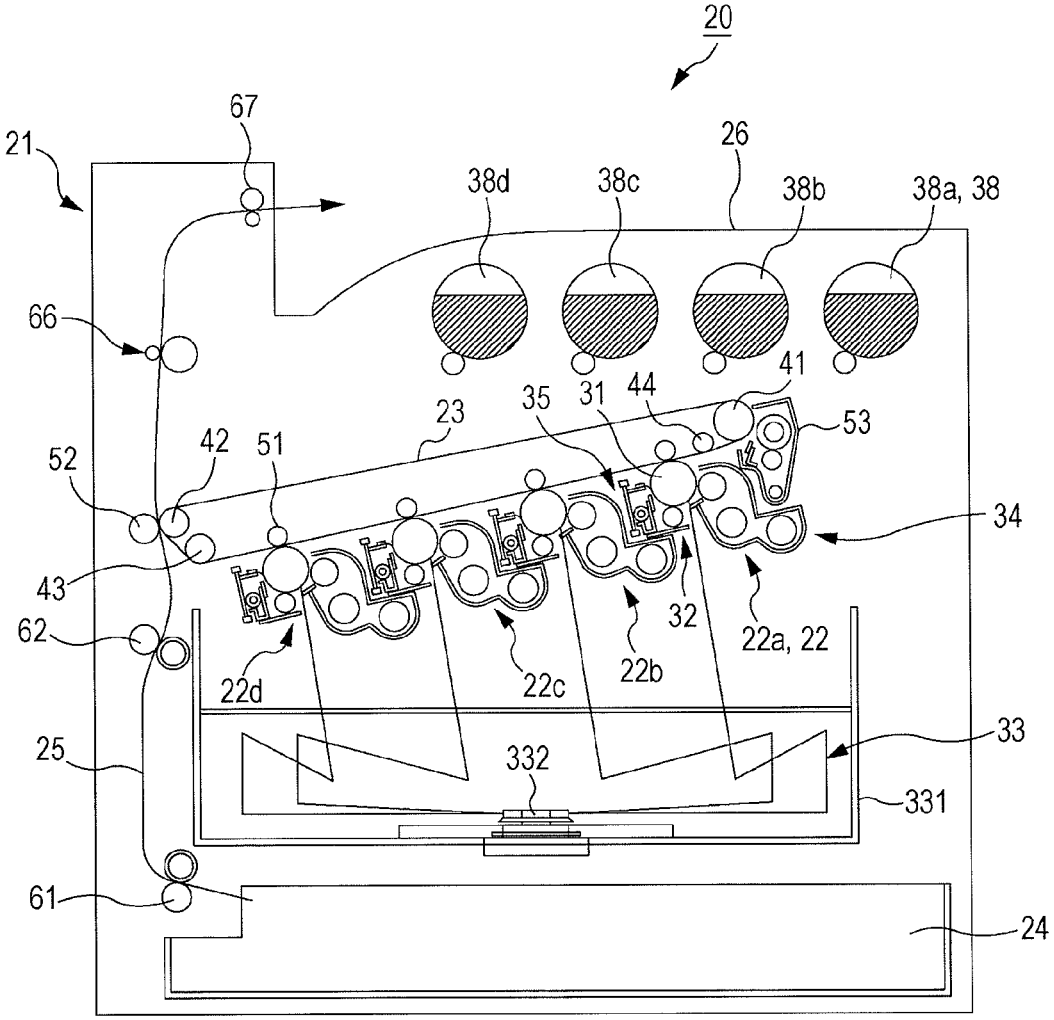
FIG. 1 illustrates the overall structure of an image forming apparatus that corresponds to a powder processing apparatus according to an exemplary embodiment of the present invention.

FIG. 1 illustrates the overall structure of an image forming apparatus 20 that corresponds to a powder processing apparatus according to the exemplary embodiment of the present invention.

The powder processing apparatus includes various types of apparatuses that perform operations using powder. In the present exemplary embodiment, an image forming apparatus, which forms an image using toner as an example of powder, is described as an example of the powder processing apparatus.

An image forming apparatus 20 illustrated in FIG. 1 includes image forming units 22*a* to 22*d* for plural colors (in this example, four colors including black, yellow, magenta, and cyan) disposed in an apparatus housing 21. In the following description, the image forming units 22*a* to 22*d* are sometimes generically referred to as image forming units 22. The image forming units 22*a* to 22*d* are arranged along a slightly inclined line that extends obliquely upward with respect to the horizontal direction so as to cross the apparatus housing 21. An intermediate transfer belt 23 is disposed above the image forming units 22*a* to 22*d* and is wound around support rollers 41 to 44 along a direction in which the image forming units 22*a* to 22*d* are arranged. The intermediate transfer belt 23 is rotated by, for example, the support roller 41 that functions as a drive roller. In the present exemplary embodiment, black, yellow, magenta, and cyan images, for example, are formed by the image forming units 22 in that order from the upstream side in the rotating direction of the intermediate transfer belt 23.

A recording-medium feeding device 24, which stores recording media such as recording paper and overhead projector (OHP) sheets, is disposed below the image forming units 22*a* to 22*d*. The recording-medium feeding device 24 is capable of feeding the recording media. A recording-medium receiver 26, which receives the recording media after the recording media having images formed thereon are ejected from the image forming apparatus 20, is provided in an upper section of the apparatus housing 21. In addition, a recording-medium transport path 25 that extends in a vertical direction is provided in the apparatus housing 21. The recording media are transported from the recording-medium feeding device 24 to the recording-medium receiver 26 along the recording-medium transport path 25.

Each image forming unit 22 is provided with a photoconductor 31 that is, for example, drum-shaped; a charging device 32 that charges the photoconductor 31 in advance; an exposure device 33 (see FIG. 1) that writes an electrostatic latent image on the photoconductor 31 that has been charged by the charging device 32; a developing device 34 that visualizes the electrostatic latent image on the photoconductor 31 with toner of each color; and a cleaning device 35 that removes the toner that remains on the photoconductor 31.

The exposure device 33 is common to all of the image forming units 22, and includes light sources, such as semiconductor lasers (not shown) for the respective colors, disposed in an exposure container 331. The exposure device 33 includes a deflecting mirror 332 that deflects and scans light emitted from each light source so that an optical image is guided to the exposure position on each of the photoconductors 31 that correspond to the light sources through imaging lenses and mirrors (not shown).

A first transfer device 51 (for example, a first transfer roller) is provided on the inner side (back side) of the rotating intermediate transfer belt 23 at a position corresponding to each photoconductor 31. A voltage with a polarity opposite to the polarity with which the toner is charged is applied to each first transfer device 51, so that the toner image on the corresponding photoconductor 31 is electrostatically transferred onto the intermediate transfer belt 23. Thus, the first transfer devices 51 perform a first transfer process in which the toner images of respective colors are successively transferred onto the intermediate transfer belt 23 in a superimposed manner.

A second transfer device 52 (for example, a second transfer roller) is provided at a position (second transfer position) corresponding to the support roller 42 that is positioned downstream of the image forming unit 22*d* at the most downstream position in the moving direction of the intermediate transfer belt 23. The second transfer device 52 performs a second transfer process in which a first transfer image on the intermediate transfer belt 23 is transferred onto a recording medium. In the second transfer process, the toner images that have been superimposed on each other in the first transfer process are simultaneously transferred onto the recording medium.

An intermediate cleaning device 53, which removes residual toner from the intermediate transfer belt 23, is provided at a position corresponding to the support roller 41, which is disposed downstream of the second transfer position and upstream of the image forming unit 22*a* at the most upstream position in the moving direction of the intermediate transfer belt 23.

The intermediate transfer belt 23 may be formed of resins, such as polyimide, polycarbonate, polyester, and polypropylene, or rubbers containing an appropriate amount of antistatic agent, such as carbon black. The intermediate transfer belt 23 is formed such that the volume resistivity thereof is in the range of $10^6$ Ω·cm to $10^{14}$ Ω·cm.

In the present exemplary embodiment, a recording medium is fed by a feeder 61 in the recording-medium feeding device 24 and conveyed by a suitable number of transport rollers (not shown) arranged along the recording-medium transport path 25. Then, the position of the recording medium is adjusted by a positioning roller 62, and the recording medium passes through the second transfer position of the second transfer device 52. At this time, the recording medium is subjected to the above-described second transfer process. Then, a fixing device 66 fixes the unfixed toner image on the recording medium by, for example, applying heat and pressure. Then, the recording medium is ejected by an ejection roller 67 and received by the recording-medium receiver 26.

Referring to FIG. 1, toner cartridges 38*a* to 38*d* are provided to supply new toner to the developing devices 34 in the image forming units 22*a* to 22*d*, respectively. In the following description, the toner cartridges 38*a* to 38*d* are sometimes generically referred to as toner cartridges 38. The toner cartridges 38 correspond to a powder container according to an exemplary embodiment. The powder container may either contain unused powder or powder that has been used and collected. In the present exemplary embodiment, powder containers containing unused powder are described as an example. The detailed structure of the toner cartridges 38 will be described below.

Image Forming Unit

Figure 2:
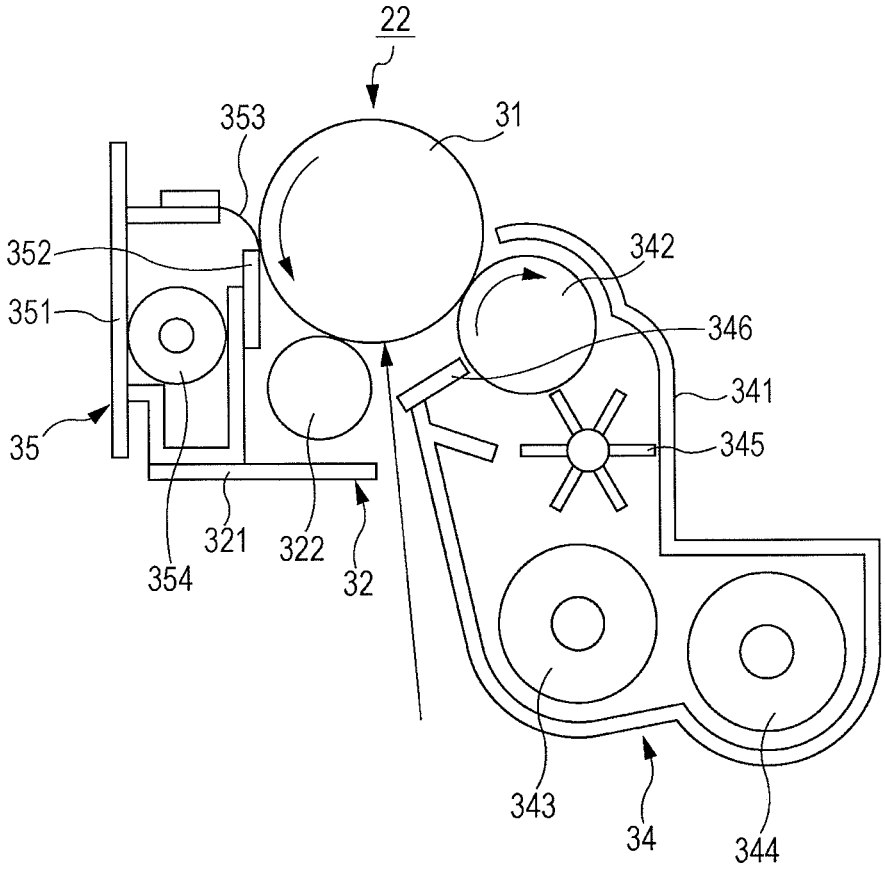
FIG. 2 illustrates the detailed structure of each image forming unit included in the image forming apparatus illustrated in FIG. 1.

FIG. 2 illustrates the detailed structure of each image forming unit 22 included in the image forming apparatus 20 illustrated in FIG. 1.

In the present exemplary embodiment, the photoconductor 31, the charging device 32, and the cleaning device 35 are integrated together as a process cartridge. The process cartridge is detachably attached to the apparatus housing 21 and serves as a part of the image forming unit 22 of each color.

The charging device 32 includes a charging container 321 having an opening that faces the photoconductor 31. A charging roller 322, which is in contact with the surface of the photoconductor 31, is disposed in the charging container 321.

The cleaning device 35 includes a cleaning container 351 having an opening that faces the photoconductor 31. A plate-shaped cleaning blade 352 is disposed at an edge of the opening that extends in the longitudinal direction of the cleaning container 351 (direction perpendicular to the plane of FIG. 2). The cleaning blade 352 is in contact with the photoconductor 31 and is formed of an elastic body. The cleaning blade 352 scrapes off residues, such as toner, from the surface of the photoconductor 31. An elastic sealing member 353 is provided at the other edge of the opening that extends in the longitudinal direction of the cleaning container 351. The sealing member 353 is also in contact with the photoconductor 31. A leveling transport member 354, which levels the residues scraped off by the cleaning blade 352 in the longitudinal direction, is disposed in the cleaning container 351.

In the present exemplary embodiment, the developing device 34 is attached to the apparatus housing 21 independently of the process cartridge. The developing device 34 includes a developing container 341 having an opening that faces the photoconductor 31 and containing developer including toner and magnetic carrier. A developer carrier 342 is disposed at the opening in the developing container 341. The developer carrier 342 carries the developer on the surface thereof and transports the developer to a developing area in which the developer carrier 342 faces the photoconductor 31. A pair of developer agitating-and-transporting members 343 and 344 that agitate the developer while circulating the developer are disposed behind the developer carrier 342 (at a bottom area of the developing container 341). A developer supplying member 345 that supplies the developer that is agitated and circulated to the developer carrier 342 is disposed between the developer carrier 342 and the developer agitating-and-transporting member 343. The developer supplied to the developer carrier 342 is supplied to the developing area after the layer thickness of the developer is regulated by a layer-thickness regulating member 346.

Developer Supplying System

Figure 3A:
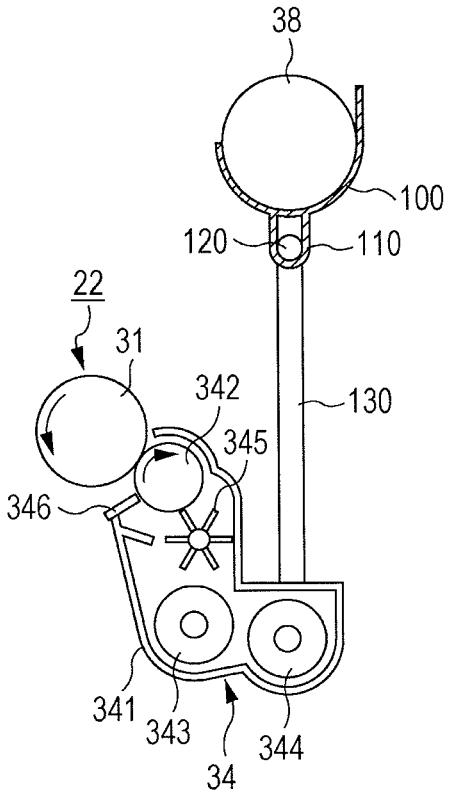
FIGS. 3A and 3B illustrate a developer supplying system according to the exemplary embodiment.
Figure 3B:
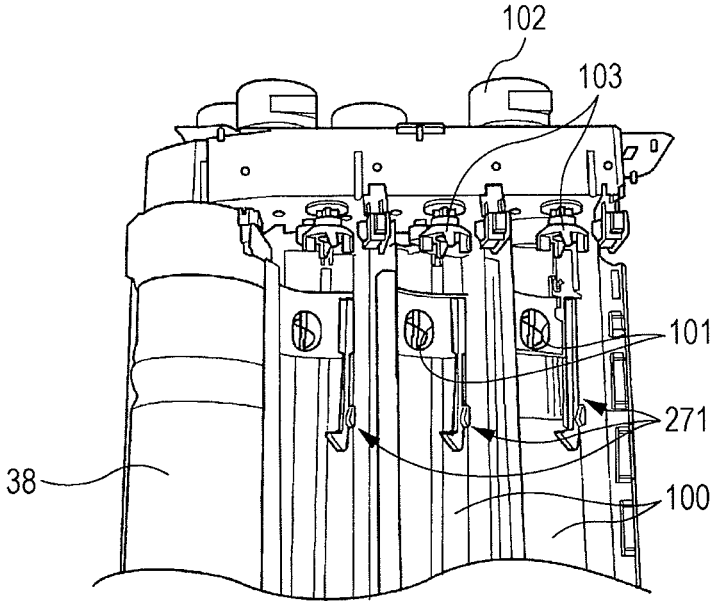

FIGS. 3A and 3B illustrate a developer supplying system according to the present exemplary embodiment.

FIG. 3A is a sectional view of the developer supplying system and a developing device 34. FIG. 3B is a top perspective view of the developer supplying system.

The developer supplying system illustrated in FIGS. 3A and 3B includes container receivers 100 which receive the respective toner cartridges 38 in a detachable manner. The toner cartridges 38 are attached to the container receivers 100 by being inserted from the front of the image forming apparatus 20 (from the bottom in FIG. 3B). Each container receiver 100 includes an elastic retainer 271 that retains an opening-closing lid of a shutter, which will be described below, when the corresponding toner cartridge 38 is attached thereto.

Each container receiver 100 is provided in a part of the apparatus housing 21, and a reserve tank 110 that temporarily stores the toner to be supplied is disposed below the container receiver 100. Each container receiver 100 has a supply port 101 through which the toner in the toner cartridge 38 is supplied to the reserve tank 110 when the toner cartridge 38 is attached to the container receiver 100. A fixed-quantity agitating-and-transporting member 120 capable of supplying a fixed quantity of toner that is stored is disposed in the reserve tank 110. A fixed amount of toner is supplied to the developing container 341 in the developing device 34 through a duct 130, which is connected to a part of the reserve tank 110, on the basis of density information, such as information showing that the developer density of a toner image has decreased.

Toner Cartridge

Figure 4:
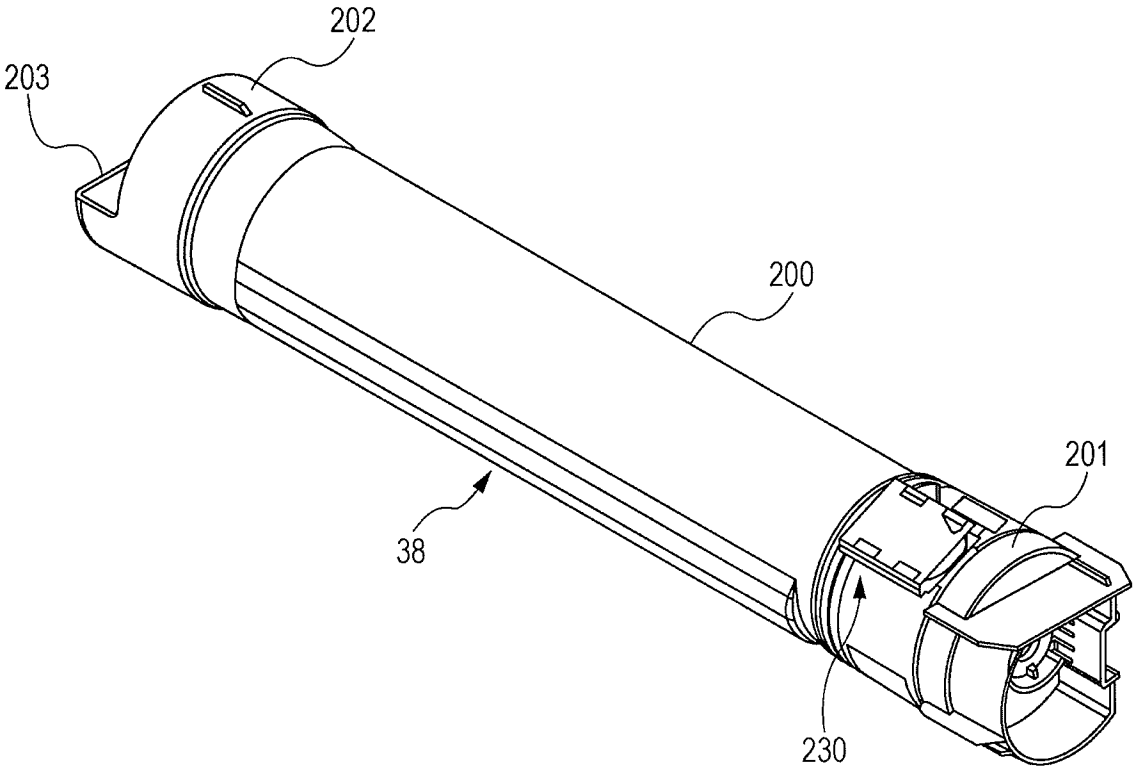
FIG. 4 illustrates the external structure of a toner cartridge.
Figure 5:
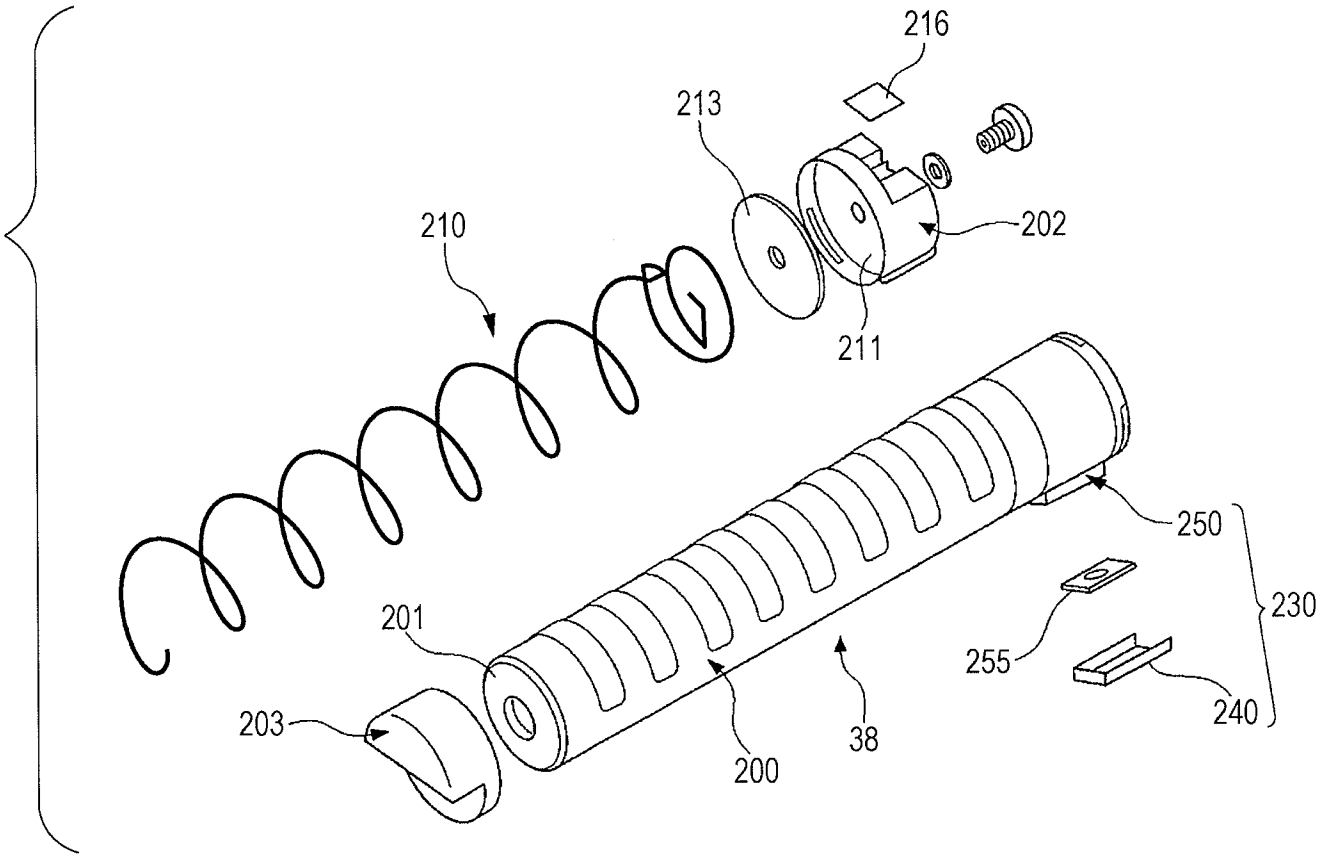
FIG. 5 is an exploded perspective view of the toner cartridge.

FIG. 4 illustrates the external structure of each toner cartridge 38. FIG. 5 is an exploded perspective view of the toner cartridge 38.

In the present exemplary embodiment, the toner cartridge 38 includes a long cylindrical container body 200 that opens at the ends thereof. The cylindrical container body 200 is formed by stretch blow molding using synthetic resin, such as acrylonitrile-butadiene-styrene copolymer (ABS resin) and polyethylene terephthalate (PET). The peripheral wall of the cylindrical container body 200 extends in an attachment-detachment direction in which the toner cartridge 38 is attached to and detached from the container receiver 100. An agitator 210, which serves as an agitating member for agitating the toner contained in the cylindrical container body 200, is provided in the cylindrical container body 200. A shutter 230 is provided on the peripheral wall of the cylindrical container body 200.

Figure 6A:
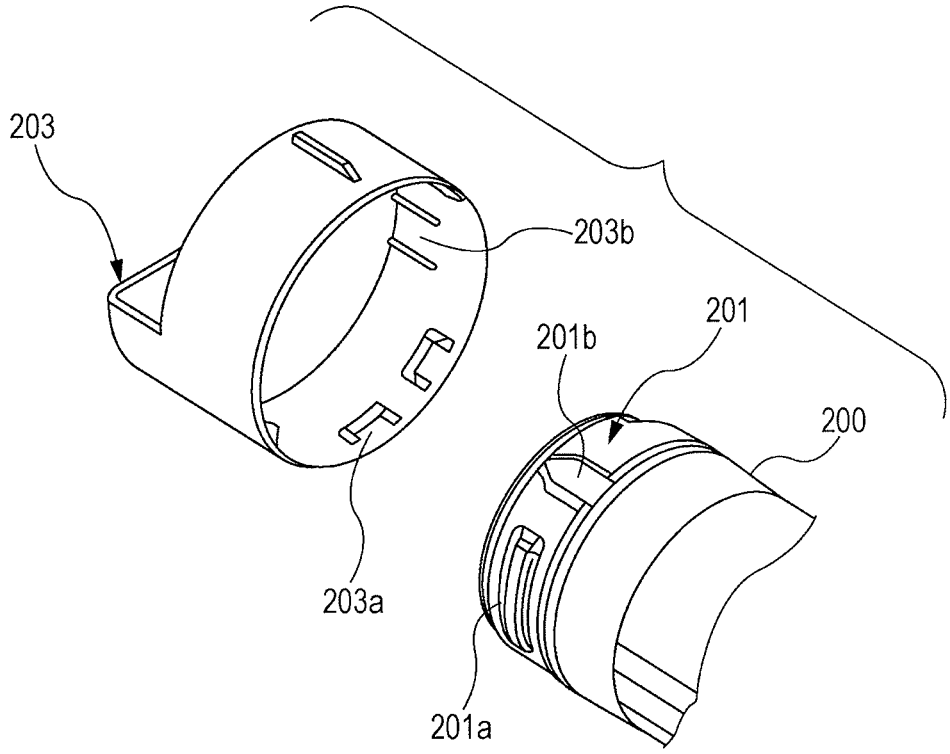
FIGS. 6A and 6B illustrate the detailed structures of end portions of a cylindrical container body.
Figure 6B:
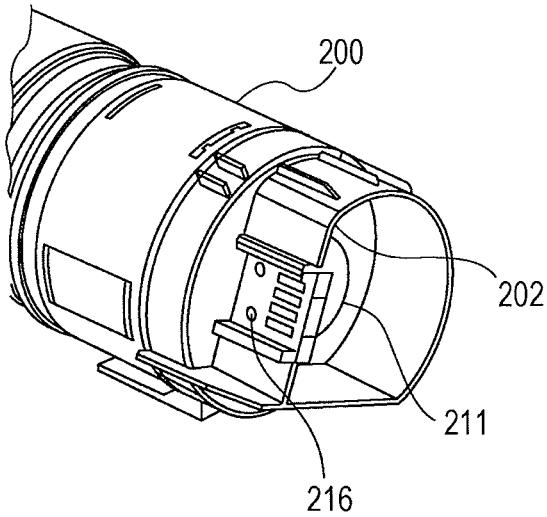

FIGS. 6A and 6B illustrate the detailed structures of end portions of the cylindrical container body 200. FIG. 6A illustrates a trailing end portion in the direction in which the toner cartridge 38 is inserted, and FIG. 6B illustrates a leading end portion in the direction in which the toner cartridge 38 is inserted.

End flanges 201 and 202 are provided at the ends of the cylindrical container body 200.

A gripping lug 203 is attached to the end flange 201 at the trailing end in the insertion direction of the toner cartridge 38 by being fitted thereto. The lug 203 is retained by the end flange 201 such that an elastic retaining piece 203*a* provided on the lug 203 is engaged with a step portion 201*a* on the end flange 201. In addition, a rotation stopper recess 203*b* formed in the lug 203 is engaged with a positioning step portion 201*b* on the end flange 201, so that the lug 203 is positioned relative to the end flange 201.

A rotor 211 is provided on the end flange 202 at the leading end in the insertion direction of the toner cartridge 38. The rotor 211 is connected to a drive shaft 103 of a drive motor 102 illustrated in FIG. 3B.

Figure 7A:
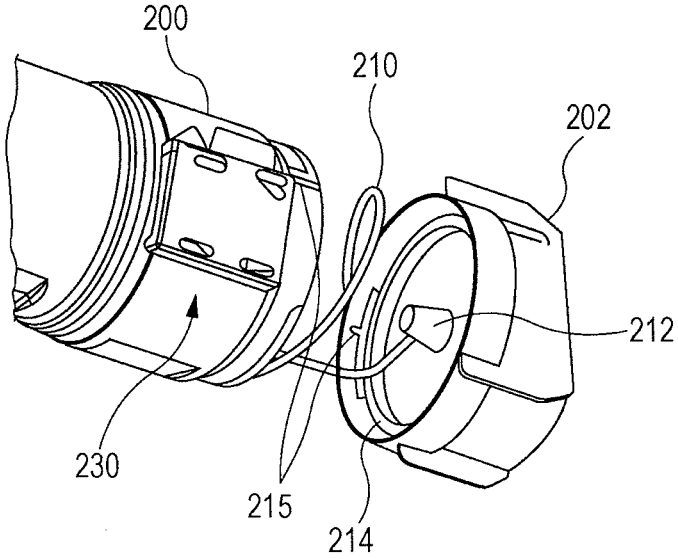
FIGS. 7A and 7B illustrate the structure in which an agitator is attached to an end flange.
Figure 7B:
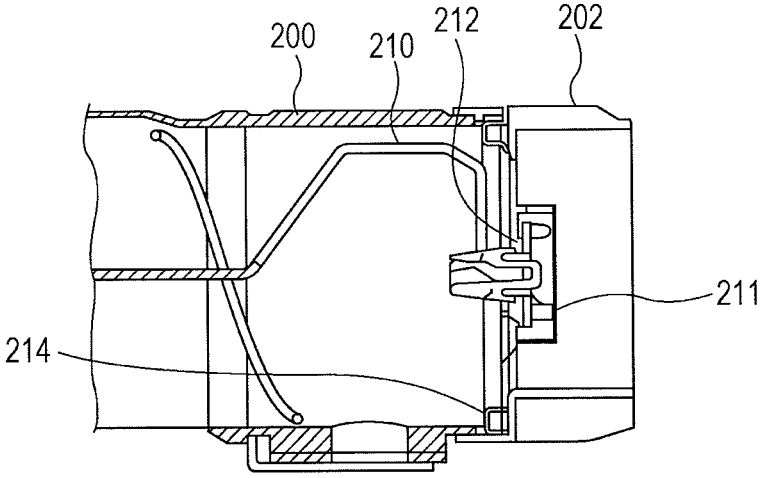

FIGS. 7A and 7B illustrate the structure in which the agitator 210 is attached to the end flange 202. FIG. 7A illustrates the state in which the end flange 202 is detached and FIG. 7B is a sectional view of the attachment structure.

A hook portion 212 is provided on an inner surface of the rotor 211 at the center thereof. An end portion of the agitator 210 is engaged with the hook portion 212. A sealing member 213 (see FIG. 5) is provided between the end flange 202 and the cylindrical container body 200. A ring-shaped sealing member 214 is provided between the rotor 211 and the end flange 202 so as to seal the gap therebetween. In addition, a rotation stopper mechanism 215 is provided in which a projection on the end flange 202 is fitted into a groove in the cylindrical container body 200 to prevent rotation between the end flange 202 and the cylindrical container body 200.

In the present exemplary embodiment, as illustrated in FIG. 6B, the end flange 202, which is disposed at the front end in the insertion direction of the toner cartridge 38, is provided with a customer replaceable unit memory (CRUM) 216, which is an example of a memory that manages the usage history. When the toner cartridge 38 is attached to the cylindrical container body 200, the CRUM 216 is communicably connected to a control device (not shown) and the usage history of the toner cartridge 38 is recorded in the CRUM 216.

Shutter

The shutter 230 provided on the toner cartridge 38 will now be described.

In the present exemplary embodiment, as illustrated in FIG. 5, the shutter 230 is provided on the peripheral wall of the cylindrical container body 200 at a position near the leading end thereof in the insertion direction of the toner cartridge 38. The shutter 230 is an example of an opening-closing mechanism that opens or closes a discharge port, which will be described below, formed in the cylindrical container body 200. The shutter 230 includes an opening-closing lid 240 and a lid-retaining frame 250.

Figure 8:
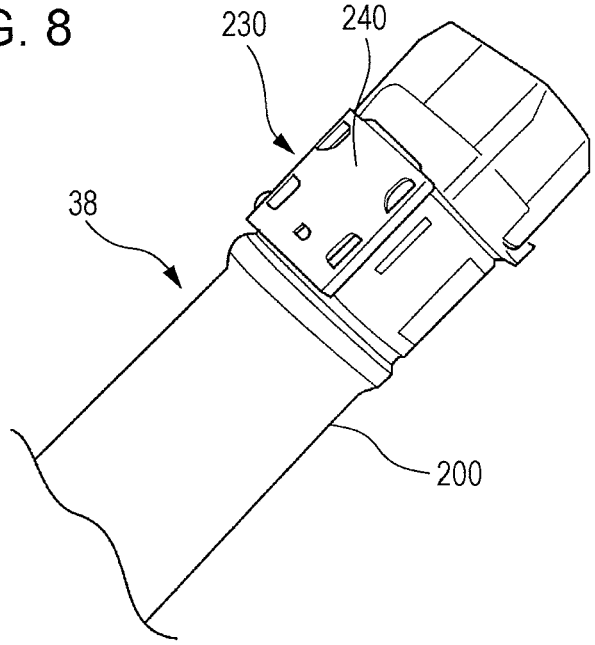
FIG. 8 illustrates a shutter in the state in which an opening-closing lid is closed.
Figure 9:
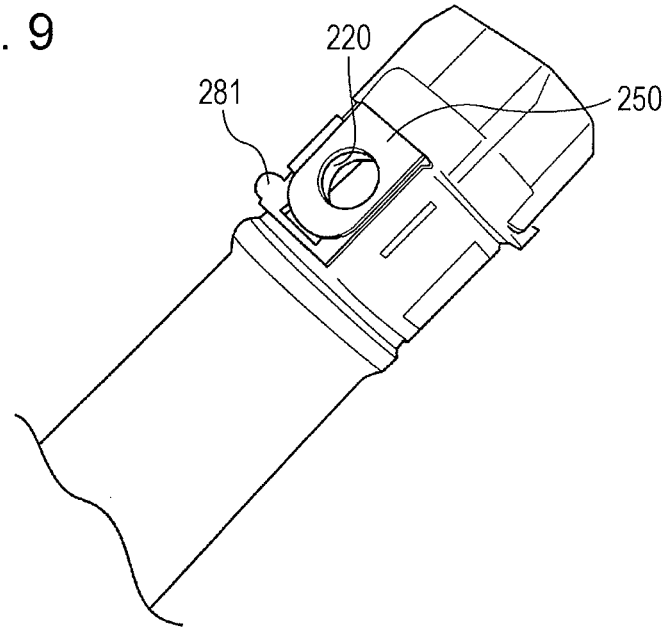
FIG. 9 illustrates a lid-retaining frame in the state in which the opening-closing lid is removed.
Figure 10:
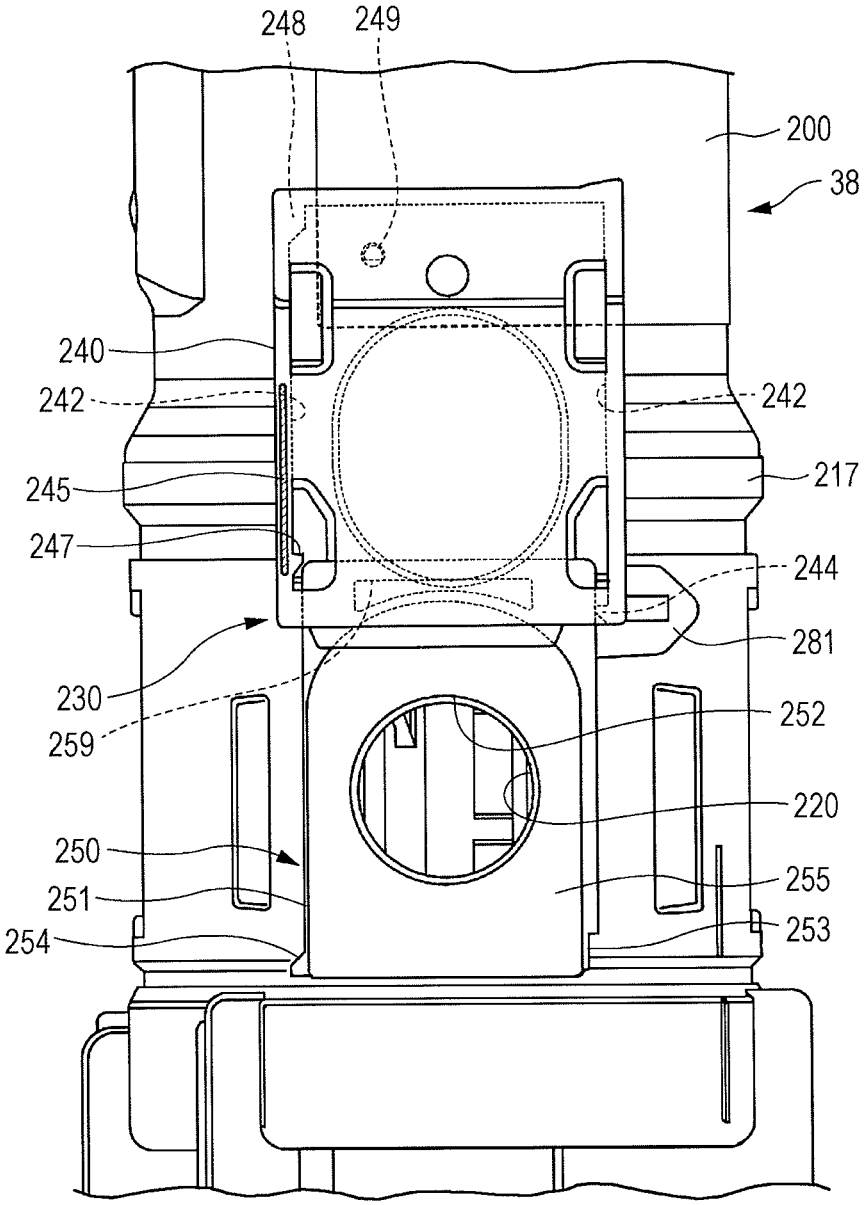
FIG. 10 illustrates the shutter in the state in which the opening-closing lid is open.

FIG. 8 illustrates the shutter 230 in the state in which the opening-closing lid 240 is closed. FIG. 9 illustrates the lid-retaining frame 250 in the state in which the opening-closing lid 240 is removed. FIG. 10 illustrates the shutter 230 in the state in which the opening-closing lid 240 is open.

A discharge port 220 is formed in the peripheral wall of the cylindrical container body 200. The opening-closing lid 240 of the shutter 230 covers the discharge port 220 as illustrated in FIG. 8. The opening-closing lid 240 is retained by the lid-retaining frame 250 such that the opening-closing lid 240 is movable along the insertion direction of the toner cartridge 38. The lid-retaining frame 250 projects from the periphery of the discharge port 220 so as to extend over the area around the discharge port 220. A protruding portion 217 that continuously extends along the circumference of the peripheral wall of the cylindrical container body 200 is provided on the peripheral wall of the cylindrical container body 200. The protruding portion 217 is positioned closer to an extraction end of the cylindrical container body 200 than the discharge port 220 and the lid-retaining frame 250 in the attachment-detachment direction of the toner cartridge 38.

The structure of each of the opening-closing lid 240 and the lid-retaining frame 250 will now be described. In the following description, the side of the opening-closing lid 240 that faces the discharge port 220 is defined as the "top side", and the side that is viewable in FIG. 8 is defined as the "bottom side". In addition, the left-right direction in FIG. 10 is defined as the "width direction".

Opening-Closing Lid

Figure 11:
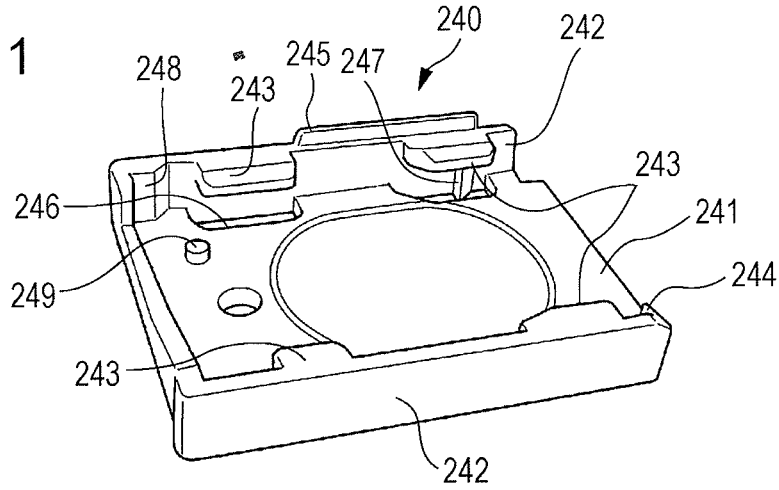
FIG. 11 is a top perspective view illustrating the detailed structure of the opening-closing lid.
Figure 12:
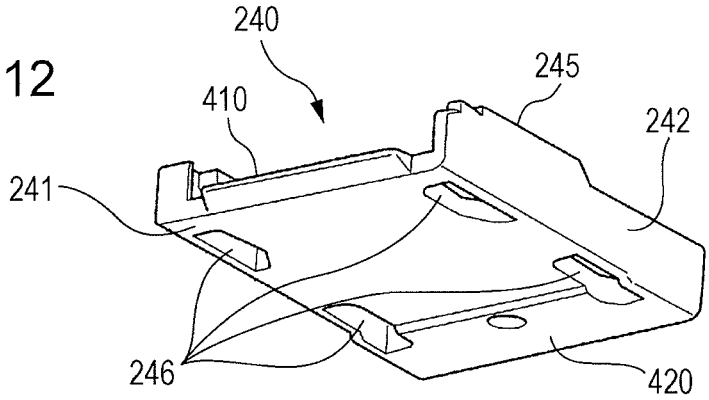
FIG. 12 is a bottom perspective view illustrating the detailed structure of the opening-closing lid.
Figure 13:
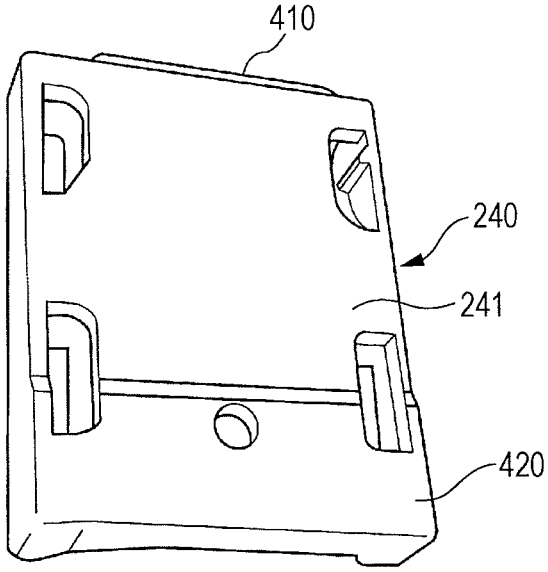
FIG. 13 is a bottom view illustrating the detailed structure of the opening-closing lid.

FIGS. 11, 12, and 13 are a top perspective view, a bottom perspective view, and a bottom view, respectively, illustrating the detailed structure of the opening-closing lid 240.

The opening-closing lid 240 includes a rectangular plate-shaped lid body 241 whose area is larger than that of the discharge port 220. The lid body 241 corresponds to an example of a plate-shaped plate portion that extends along the peripheral wall of the cylindrical container body 200. The opening-closing lid 240 also includes side wall portions 242 at three of the fourth sides of the lid body 241, more specifically, at the sides excluding the side at an end in a closing direction of the opening-closing lid 240. The side wall portions 242 project toward the peripheral wall of the cylindrical container body 200 from the lid body 241, which is an example of a plate portion. Of the three side wall portions 242, two side wall portions 242 at the opposing sides (that is, at the two sides that extend in the attachment-detachment direction of the toner cartridge 38 or the opening-closing direction of the opening-closing lid 240) are provided with an appropriate number of retaining arms 243. The retaining arms 243 project into the area surrounded by the side wall portions 242 so as to hold the lid-retaining frame 250. Here, two retaining arms 243 are provided on each side wall portion 242 with a space therebetween in the opening-closing direction. The two side wall portions 242 at the opposing sides are examples of a pair of sandwiching portions that sandwich the retaining frame in a direction that crosses the attachment-detachment direction (substantially the same as the opening-closing direction). An engagement lug 244 is formed at an open end of one of the two side wall portions 242 at the opposing sides. When the opening-closing lid 240 is closed, the engagement lug 244 engages with the lid-retaining frame 250. The thickness of the engagement lug 244 is reduced toward the projecting end thereof, so that the end portion of the engagement lug 244 is easily elastically deformed. An auxiliary projection 248 is provided at a bottom corner at an end opposite to the open end of the other one of the two side wall portions 242 at the opposing sides. The auxiliary projection 248 projects toward the lid-retaining frame 250. A restraining projection 247 is provided on the side wall portion 242 on which the auxiliary projection 248 is formed. The restraining projection 247 is disposed near the open end at an intermediate position in the direction in which the side wall portion 242 extends, and projects into the area surrounded by the side wall portions 242. The restraining projection 247 comes into contact with the lid-retaining frame 250 and restrains the opening-closing lid 240 from moving in the width direction. The restraining projection 247 corresponds to a regulating portion that projects toward the lid-retaining frame 250 at an intermediate position of one of the sandwiching portions and regulates the movement of the opening-closing lid 240 toward the lid-retaining frame 250. A rib 245 that projects upward (toward the cylindrical container body 200 of the toner cartridge 38) is provided on the side wall portion 242 on which the auxiliary projection 248 is formed. The rib 245 extends along the side wall portion 242. As described in detail below, if the opening-closing lid 240 is inclined, the rib 245 comes into contact with the protruding portion 217 illustrated in FIG. 10 to reduce the inclination thereby acting as a suppressing body. Although the rib 245 is not visible in the view of FIG. 10, the area in which the rib 245 is arranged is shown by hatching in FIG. 10 to clarify the positional relationship between the rib 245 and the protruding portion 217.

The lid body 241 has holes 246 at positions corresponding to the retaining arms 243. The opening-closing lid 240 retains the lid-retaining frame 250 by means of a three-point suspension at the two retaining arms 243 and a portion of the lid body 241 between the retaining arms 243. Owing to the three-point suspension, the opening-closing lid 240 stably moves along the side edges of the lid-retaining frame 250.

The lid body 241 of the opening-closing lid 240 is provided with a stopper projection 249 that projects upward (toward the lid-retaining frame 250) in the area surrounded by the side wall portions 242. The stopper projection 249 is fitted into a stopper groove 259 (see FIG. 10) formed in the lid-retaining frame 250 when, for example, the lid body 241 of the opening-closing lid 240 is deformed by an external force, so that the opening-closing lid 240 may be prevented from being opened by accident.

A regulating member 410 having a triangular shape in cross section is provided at the front side of the lid body 241 of the opening-closing lid 240 in the closing direction of the opening-closing lid 240. The regulating member 410 projects forward in the closing direction. When the toner cartridge 38 is inserted along the attachment-detachment direction, the regulating member 410 comes into contact with the lid-retaining frame 250, so that the movement of the opening-closing lid 240 is regulated.

The lid body 241 of the opening-closing lid 240 has a step portion 420 at the bottom side thereof. The step portion 420 is provided at a position separated from the regulating member 410 (that is, at the back side in the closing direction of the opening-closing lid 240) such that the step portion 420 projects downward with respect to other areas at the bottom side. The step portion 420 has a function of suppressing the occurrence of inclination of the opening-closing lid 240, as described in detail below.

The structure of the lid-retaining frame 250 will now be described in detail with reference to FIG. 10.

Lid-Retaining Frame

As illustrated in FIG. 10, the lid-retaining frame 250 includes a substantially rectangular plate-shaped frame body 251. The frame body 251 has a through hole 252 that extends through the frame body 251 and communicates with the discharge port 220. A sealing member 255 made of an elastic body is arranged around the through hole 252 in the frame body 251 so as to seal the gap between the frame body 251 and the opening-closing lid 240.

A notch-shaped stopper portion 253 is formed in a corner portion of the frame body 251 at one end of a side edge of the frame body 251 at the front end thereof in the closing direction of the opening-closing lid 240. The engagement lug 244 on the opening-closing lid 240 engages with the stopper portion 253. A regulating projection 254 is formed on a corner portion at the other end of the side edge such that the regulating projection 254 projects in the direction in which the side edge extends (that is, in the width direction). When the opening-closing lid 240 is closed, the regulating projection 254 pushes the corresponding side wall portion 242 of the opening-closing lid 240 to regulate the movement of the opening-closing lid 240 in the width direction. Accordingly, the engagement lug 244 is not easily released from the stopper portion 253 of the lid-retaining frame 250 while the opening-closing lid 240 is closed. In addition, the restraining projection 247 on one of the side wall portions 242 restrains the movement of the opening-closing lid 240 in the width direction, so that the engagement lug 244 on the opening-closing lid 240 is prevented from being released from the stopper portion 253 of the lid-retaining frame 250 by, for example, an accidental external force.

In the state illustrated in FIG. 10, the opening-closing lid 240 is opened and is retained by the elastic retainer 271 in the corresponding container receiver 100 illustrated in FIG. 3B. In the state illustrated in FIG. 10, the position of the restraining projection 247 in the opening-closing direction of the opening-closing lid 240 overlaps the position of the side edge of the lid-retaining frame 250 at the front end thereof in the opening direction of the opening-closing lid 240. In addition, in the state illustrated in FIG. 10, the position of the rib 245 on the opening-closing lid 240 overlaps the position of the protruding portion 217 in the view of FIG. 10. Since the rib 245 and the protruding portion 217 are positioned as described above, even when the opening-closing lid 240 is inclined, the rib 245 and the protruding portion 217 reliably come into contact with each other to reduce the inclination, as described below.

In the present exemplary embodiment, a releasing projection 281 is provided near the lid-retaining frame 250 of the shutter 230. When the toner cartridge 38 is extracted from the corresponding container receiver 100 illustrated in FIG. 3B, the releasing projection 281 comes into contact with the elastic retainer 271 and deforms the elastic retainer 271 so that the opening-closing lid 240 is released from the elastic retainer 271.

An opening-closing operation in which the shutter 230 having the above-described structure is opened and closed will now be described.

Shutter Operation

According to the present exemplary embodiment, in the opening-closing operation of the shutter 230, the state of the shutter 230 is changed between four states, which are (1) closed state, (2) locked state, (3) unlocked state, and (4) open state.

Figure 14:
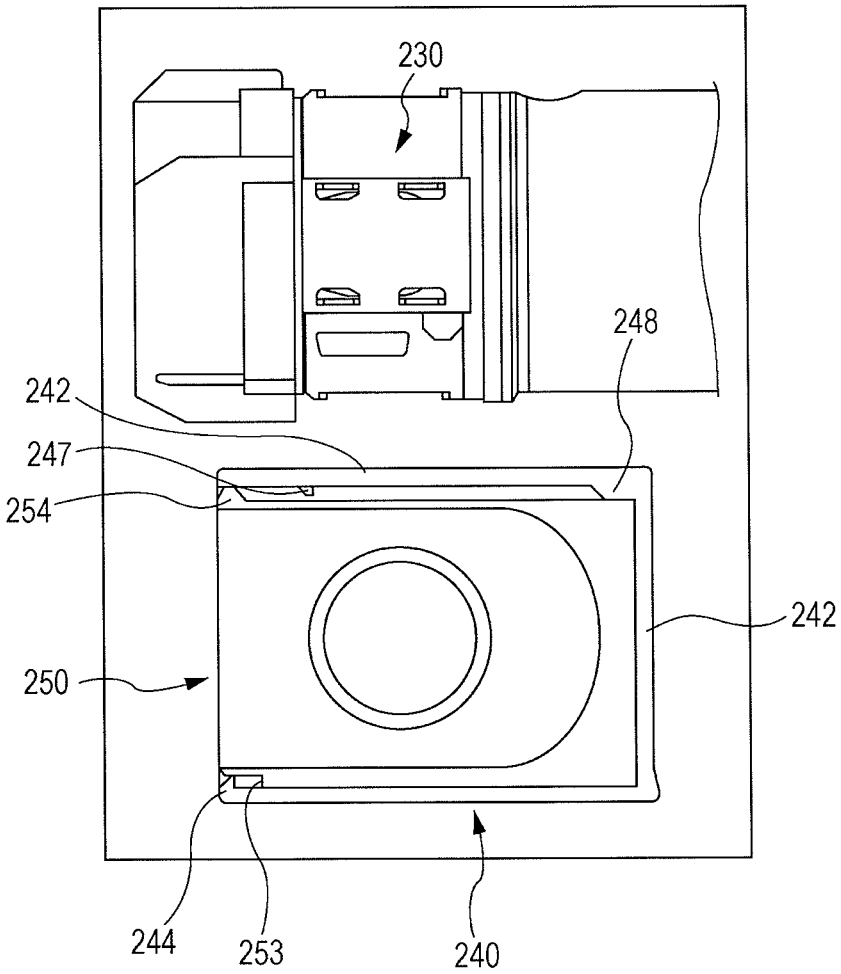
FIG. 14 is an external view illustrating the shutter in a closed state.
Figure 15A:
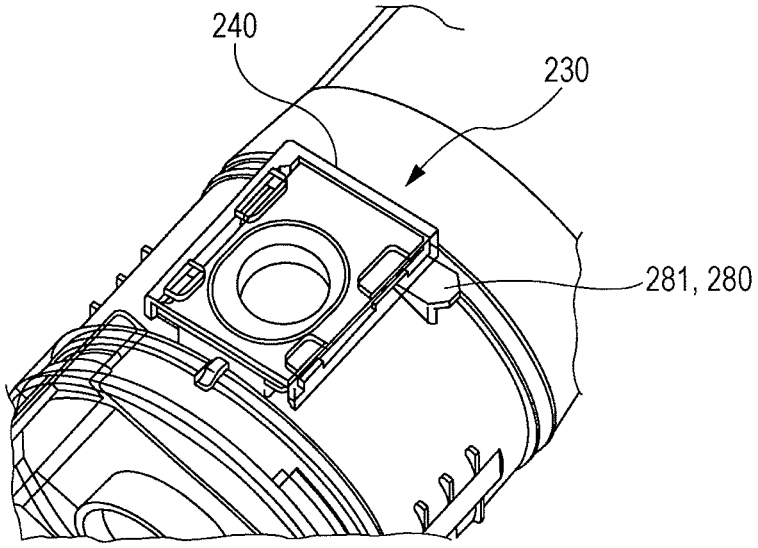
FIGS. 15A and 15B illustrate the shutter in the closed state in a see-through manner.
Figure 15B:
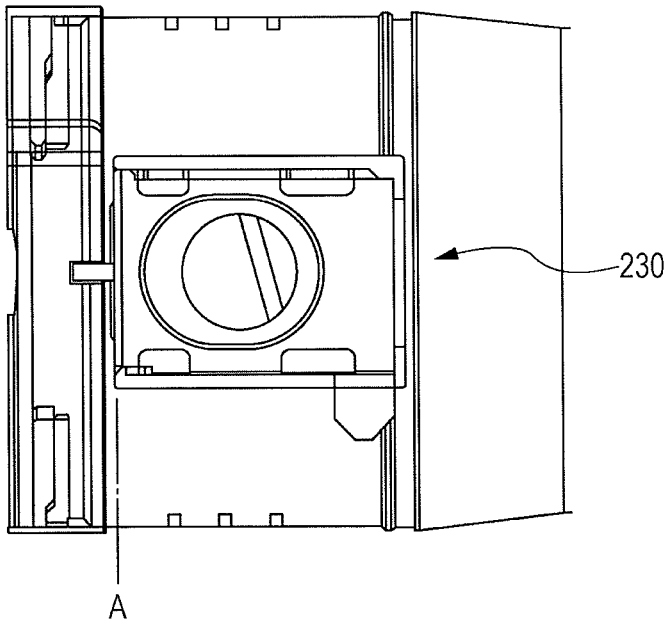

FIGS. 14, 15A, and 15B illustrate the shutter 230 in the closed state. FIG. 14 illustrates the external appearance of the shutter 230 and the positional relationship between the opening-closing lid 240 and the lid-retaining frame 250 in the shutter 230. FIGS. 15A and 15B illustrate the opening-closing lid 240 and the lid-retaining frame 250 of the shutter 230 in the closed state in a see-through manner. FIGS. 15A and 15B are a perspective view and a front view, respectively.

When the shutter 230 is in the closed state, the opening-closing lid 240 is at a closed position at which the discharge port 220 is completely covered by the opening-closing lid 240.

When the opening-closing lid 240 is at the closed position, as illustrated in FIG. 14, the side wall portion 242 at an end of the opening-closing lid 240 in the opening-closing direction is in contact with an end portion of the lid-retaining frame 250. In addition, the side wall portion 242 at one end of the opening-closing lid 240 in the width direction is in contact with the end of the regulating projection 254 on the lid-retaining frame 250. In this example, the auxiliary projection 248 on the opening-closing lid 240 is in contact with the lid-retaining frame 250, so that the opening-closing lid 240 is arranged straight along the opening-closing direction when the opening-closing lid 240 is at the closed position.

Figure 16:
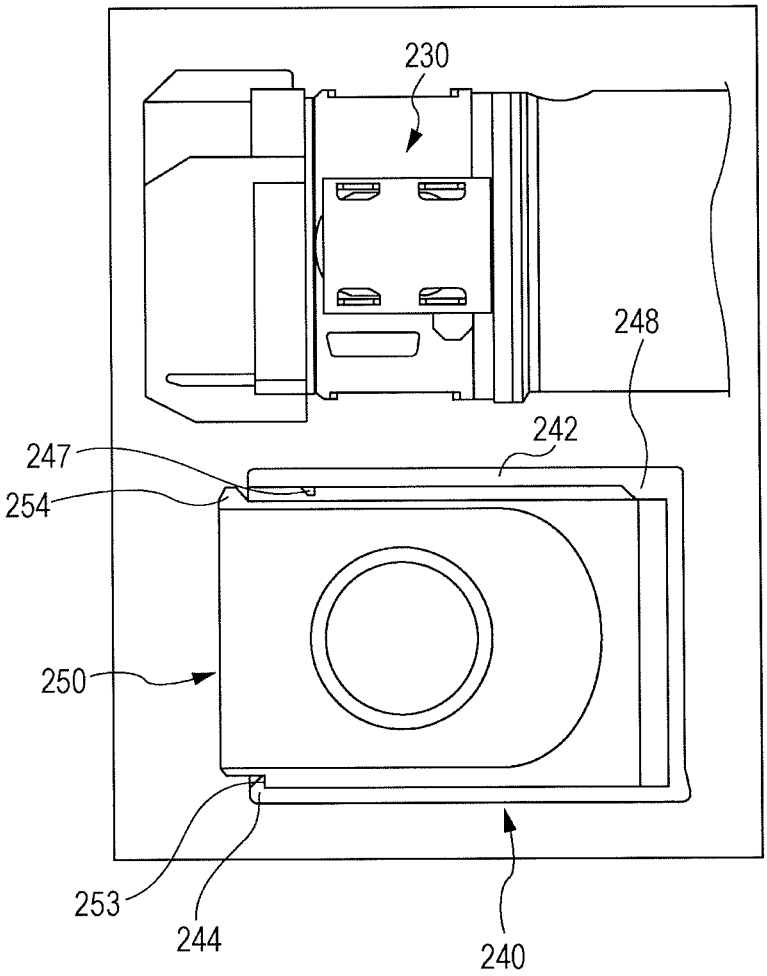
FIG. 16 is an external view illustrating the shutter in a locked state.
Figure 17A:
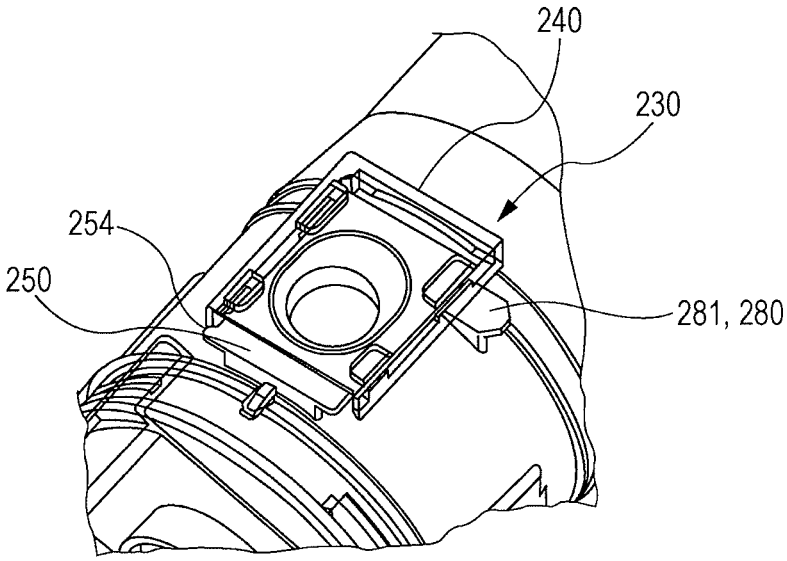
FIGS. 17A and 17B illustrate the shutter in the locked state in a see-through manner.
Figure 17B:
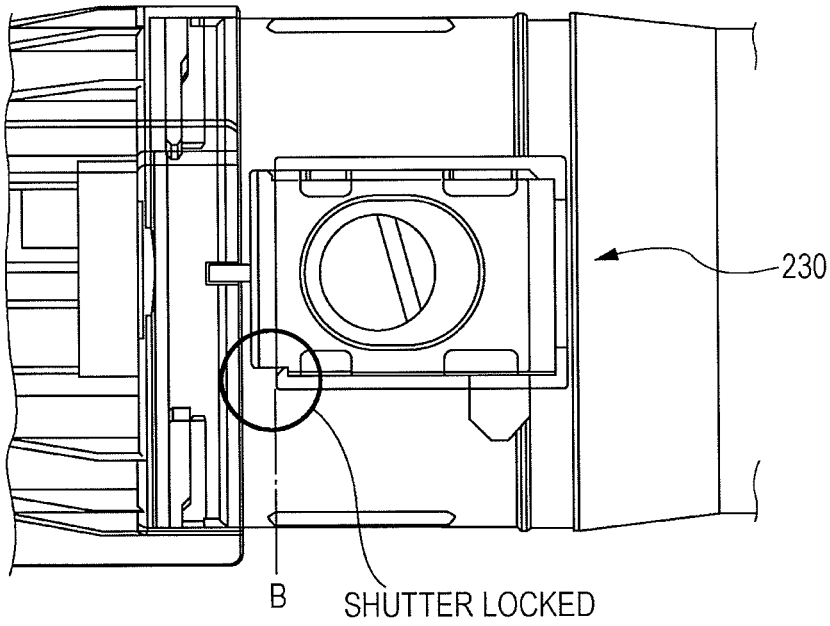

FIGS. 16, 17A, and 17B illustrate the shutter 230 in the locked state. FIG. 16 illustrates the external appearance of the shutter 230 and the positional relationship between the opening-closing lid 240 and the lid-retaining frame 250 in the shutter 230 in the locked state. FIGS. 17A and 17B illustrate the opening-closing lid 240 and the lid-retaining frame 250 of the shutter 230 in the locked state in a see-through manner. FIGS. 17A and 17B are a perspective view and a front view, respectively.

Referring to FIGS. 16, 17A, and 17B, if the opening-closing lid 240 of the shutter 230 in the closed state is moved in the opening direction, the opening-closing lid 240 is moved while the position thereof is regulated by the regulating projection 254. Then, the engagement lug 244 on the opening-closing lid 240 comes into contact with the stopper portion 253. At this time, the side wall portion 242 of the opening-closing lid 240 at the end corresponding to the regulating projection 254 on the lid-retaining frame 250 in the width direction of the opening-closing lid 240 is moved beyond the regulating projection 254. However, since the movement of the opening-closing lid 240 is restrained before the opening-closing lid 240 reaches the position where the opening-closing lid 240 starts to open, the shutter 230 is locked in the opening-closing direction.

Therefore, even when, for example, the toner cartridge 38 is accidentally dropped while being inserted or when the toner cartridge 38 is transported in a corrugated box without cushioning materials, such as styrene foam, arranged at both sides thereof, the shutter 230 may be prevented from being opened by accident.

Figure 18:
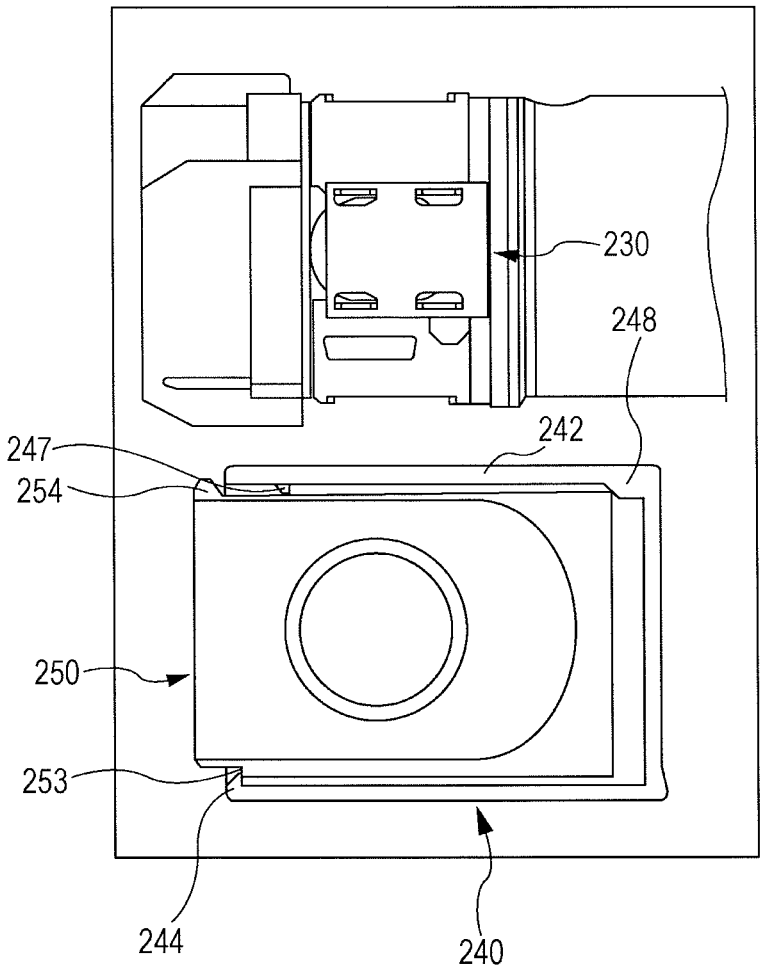
FIG. 18 is an external view illustrating the shutter in a unlocked state.
Figure 19A:
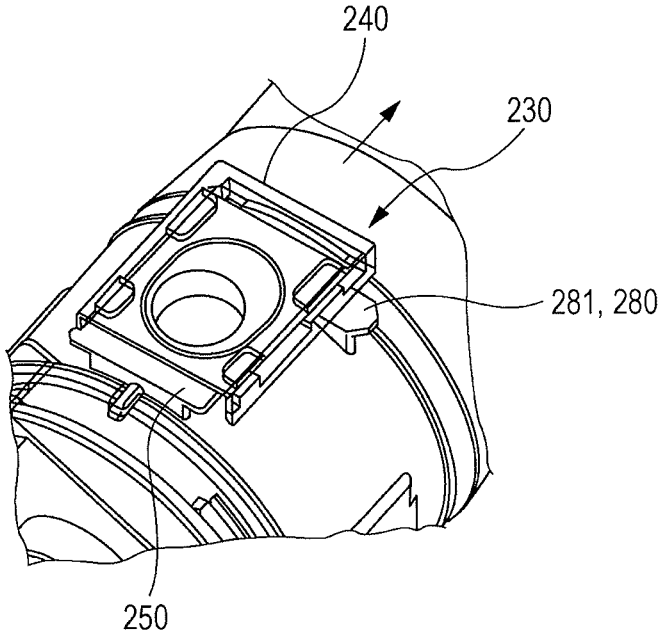
FIGS. 19A and 19B illustrate the shutter in the unlocked state in a see-through manner.
Figure 19B:
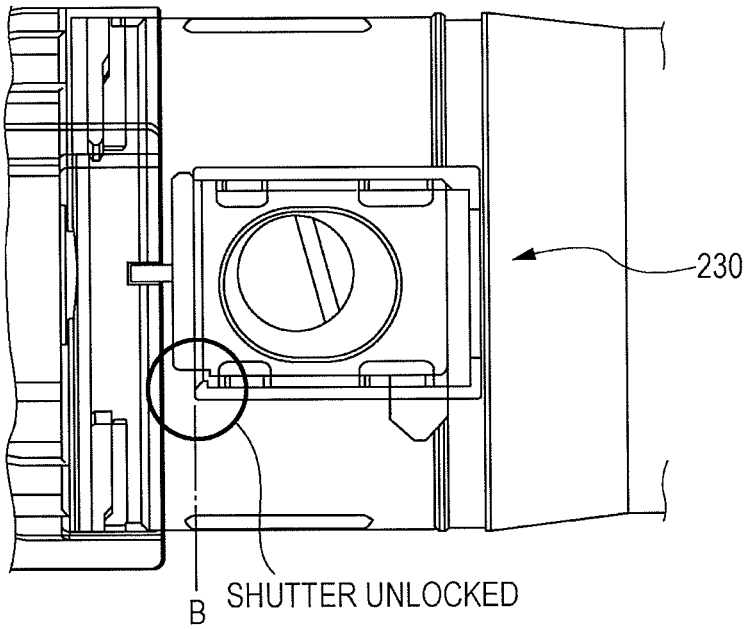

FIGS. 18, 19A, and 19B illustrate the shutter 230 in the unlocked state. FIG. 18 illustrates the external appearance of the shutter 230 and the positional relationship between the opening-closing lid 240 and the lid-retaining frame 250 in the shutter 230 in the unlocked state. FIGS. 19A and 19B illustrate the opening-closing lid 240 and the lid-retaining frame 250 of the shutter 230 in the unlocked state in a see-through manner. FIGS. 19A and 19B are a perspective view and a front view, respectively.

As described above, when the shutter 230 is in the locked state, the side wall portion 242 of the opening-closing lid 240 is moved beyond the regulating projection 254 of the lid-retaining frame 250. Therefore, the opening-closing lid 240 is allowed to move toward the lid-retaining frame 250 in the width direction that crosses the opening-closing direction. However, the movement of the opening-closing lid 240 stops when the restraining projection 247 formed on the side wall portion 242 at one end of the opening-closing lid 240 in the width direction thereof comes into contact with a side edge of the lid-retaining frame 250.

Accordingly, the engagement lug 244 on the opening-closing lid 240 moves from the position illustrated in FIGS. 16, 17A, and 17B at which the engagement lug 244 is deeply engaged with the stopper portion 253 of the lid-retaining frame 250 to the position illustrated in FIGS. 18, 19A, and 19B at which the engagement lug 244 is slightly engaged with the stopper portion 253. Thus, a double-lock configuration is provided in which the engagement lug 244 remains engaged with the stopper portion 253 even when the opening-closing lid 240 is moved. Accordingly, if the movement of the opening-closing lid 240 is caused by, for example, an unintended external force, the shutter 230 is prevented from being unlocked. When the shutter 230 is to be opened, an operation force for further moving the opening-closing lid 240 rightward in FIG. 18 is applied to the opening-closing lid 240 while the engagement lug 244 is slightly engaged with the stopper portion 253. As a result, the engagement lug 244 is elastically deformed and released from the stopper portion 253, so that the opening-closing lid 240 is allowed to move in the opening-closing direction. In other words, the opening-closing lid 240 is released from the state in which the opening-closing lid 240 is restrained by the engagement between the stopper portion 253 and the engagement lug 244. Thus, the shutter 230 is released form the state in which the shutter 230 is locked in the opening-closing direction.

Figure 20:
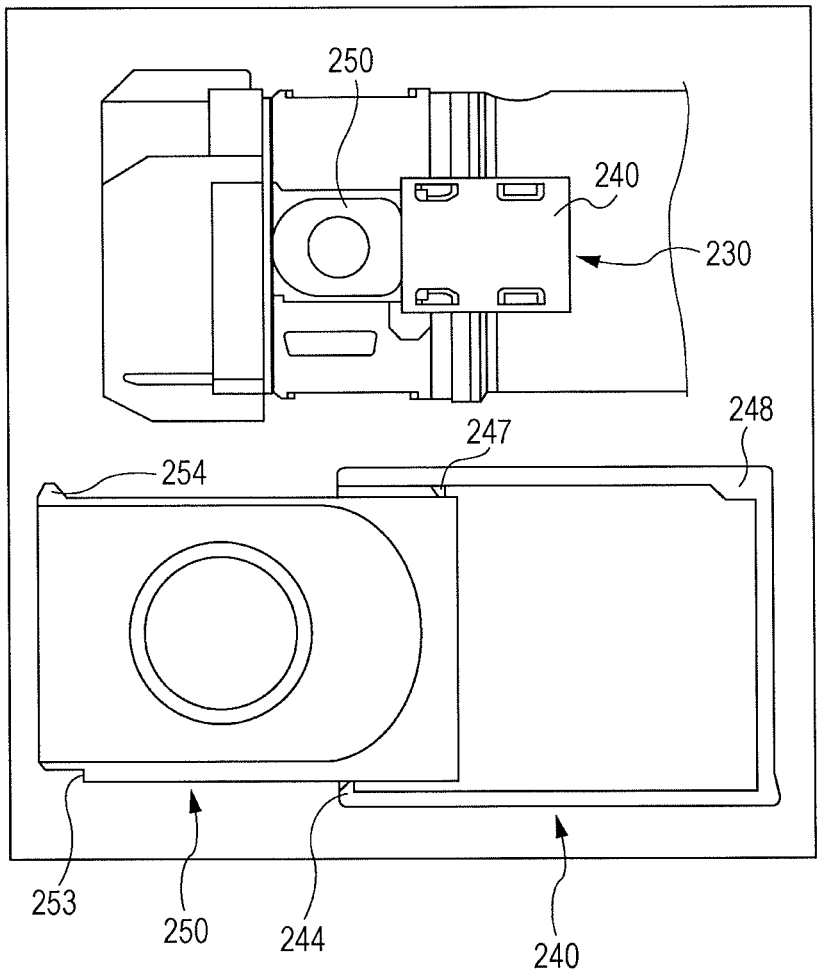
FIG. 20 is an external view illustrating the shutter in an open state.
Figure 21A:
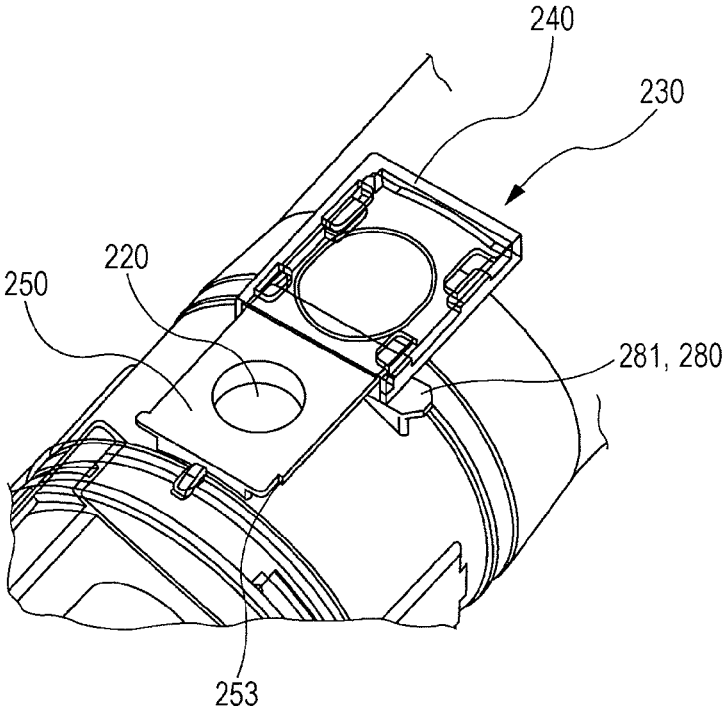
FIGS. 21A and 21B illustrate the shutter in the open state in a see-through manner.
Figure 21B:
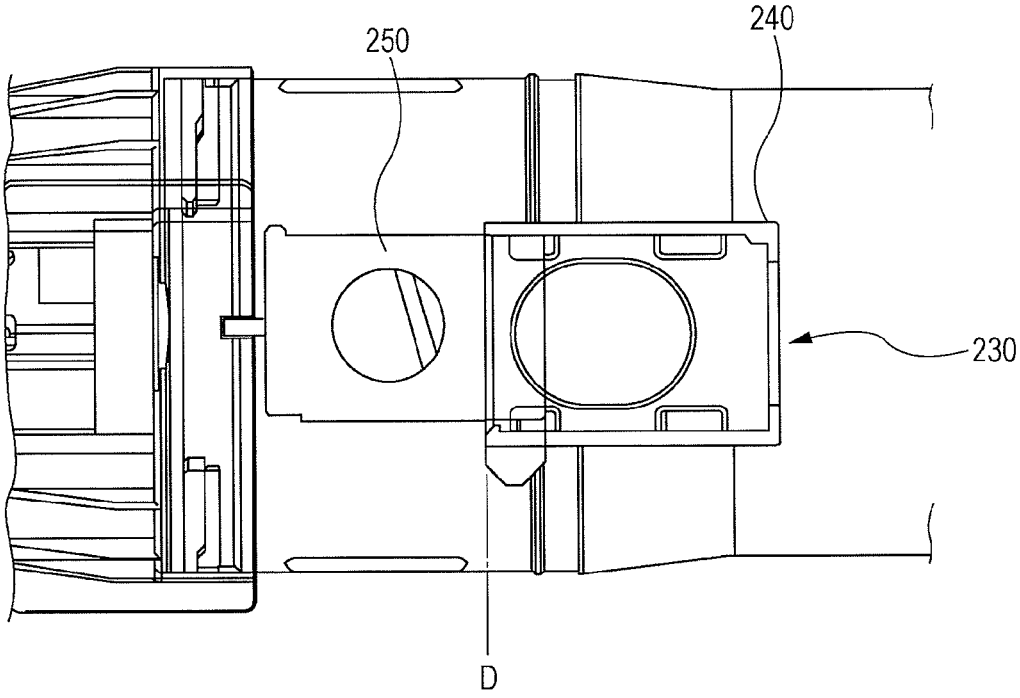

FIGS. 20, 21A, and 21B illustrate the shutter 230 in the open state. FIG. 20 illustrates the external appearance of the shutter 230 and the positional relationship between the opening-closing lid 240 and the lid-retaining frame 250 in the shutter 230 in the open state. FIGS. 21A and 21B illustrate the opening-closing lid 240 and the lid-retaining frame 250 of the shutter 230 in the open state in a see-through manner. FIGS. 21A and 21B are a perspective view and a front view, respectively.

As described above, when the shutter 230 is released from the locked state, the opening-closing lid 240 is allowed to move in the opening-closing direction. Accordingly, as illustrated in FIGS. 20, 21A, and 21B, the opening-closing lid 240 is moved to the open position at which the discharge port 220 is completely open.

At this time, the engagement lug 244 on the opening-closing lid 240 is moved while being in elastic contact with a side edge of the lid-retaining frame 250, as illustrated in FIG. 20. Accordingly, the opening-closing lid 240 is moved to the end position (open position) without being impeded.

In the present exemplary embodiment, it is not necessary to apply an urging force of a spring or the like between the opening-closing lid 240 and the lid-retaining frame 250 in this state. Therefore, the opening-closing lid 240 may be moved in the opening-closing direction without applying a strong operation force.

Container Receiver

In the present exemplary embodiment, each container receiver 100 includes a functional part that performs the opening-closing operation of the shutter 230 through the above-described four states, that is, (1) closed state, (2) locked state, (3) unlocked state, and (4) open state, when the toner cartridge 38 is inserted or extracted.

Figure 22:
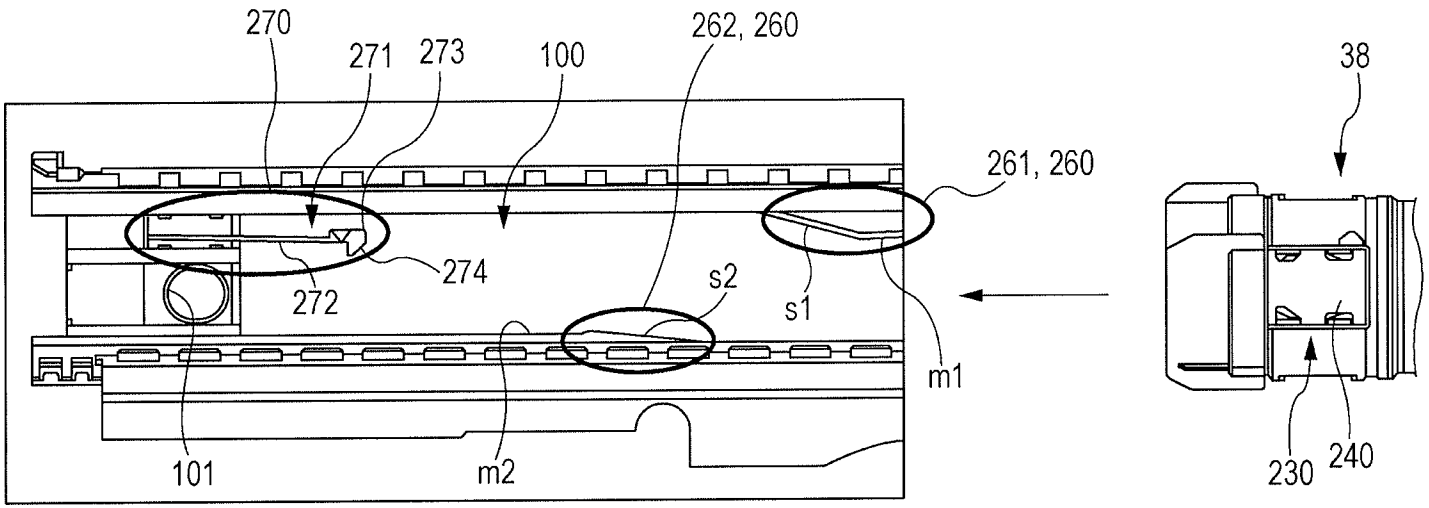
FIG. 22 illustrates a functional part provided on a container receiver to perform an opening-closing operation of the shutter.
Figure 24B:
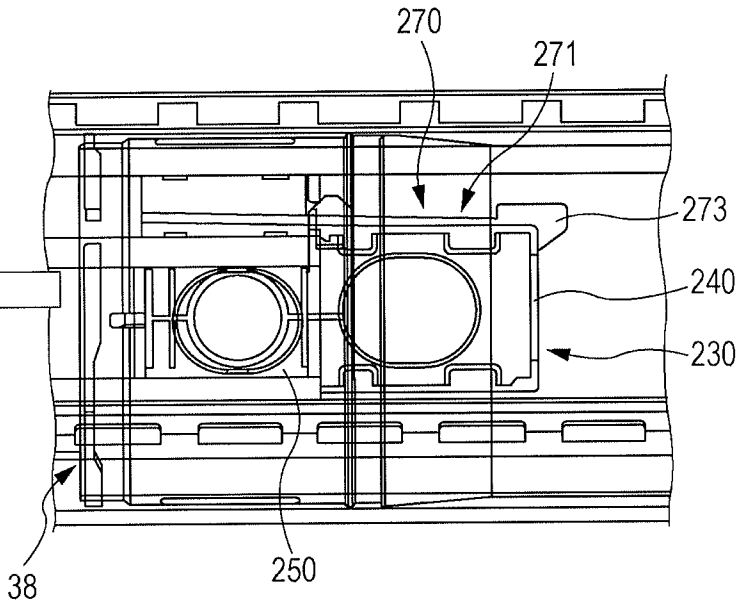
FIGS. 24A and 24B illustrate the manner in which the state of the shutter is changed from the unlocked state to the open state in the shutter opening operation performed by the functional part provided on the container receiver.
Figure 24A:
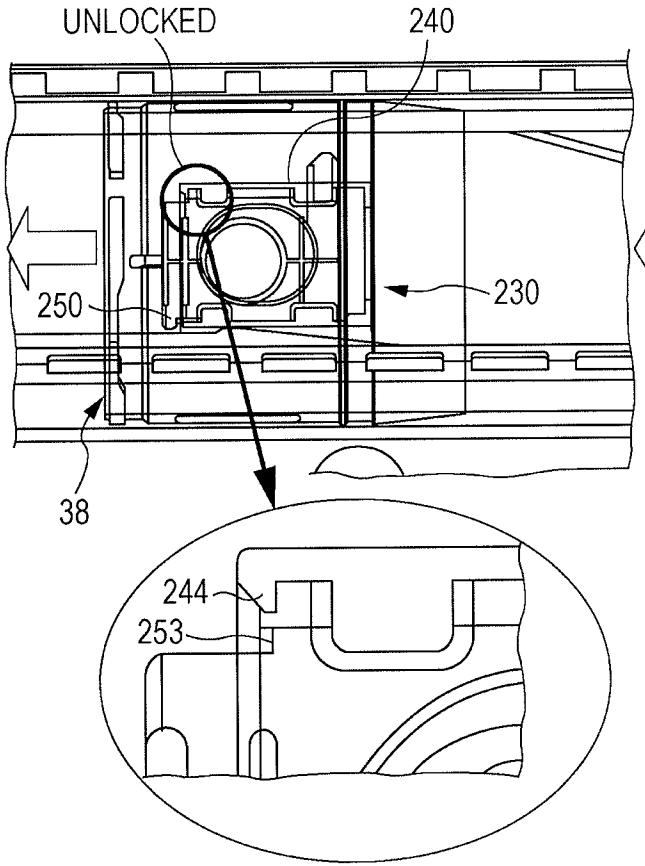
Figure 25B:
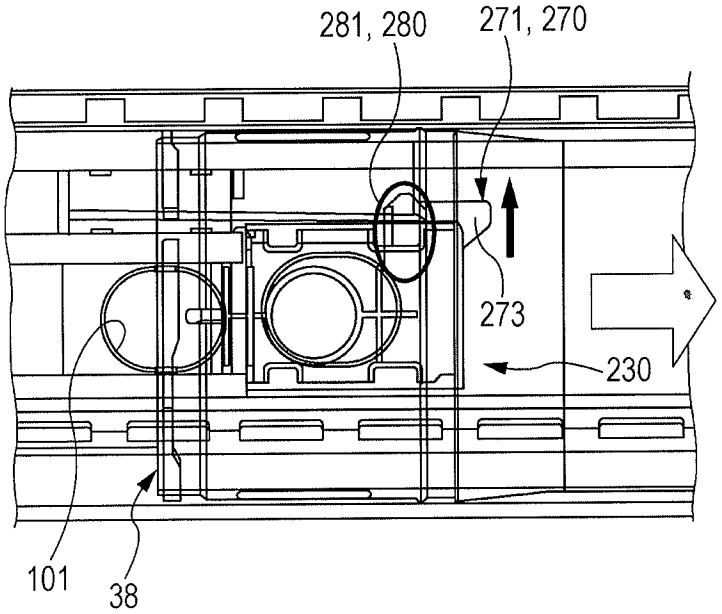
FIGS. 25A and 25B illustrate a shutter closing operation performed by the functional part provided on the container receiver.
Figure 25A:
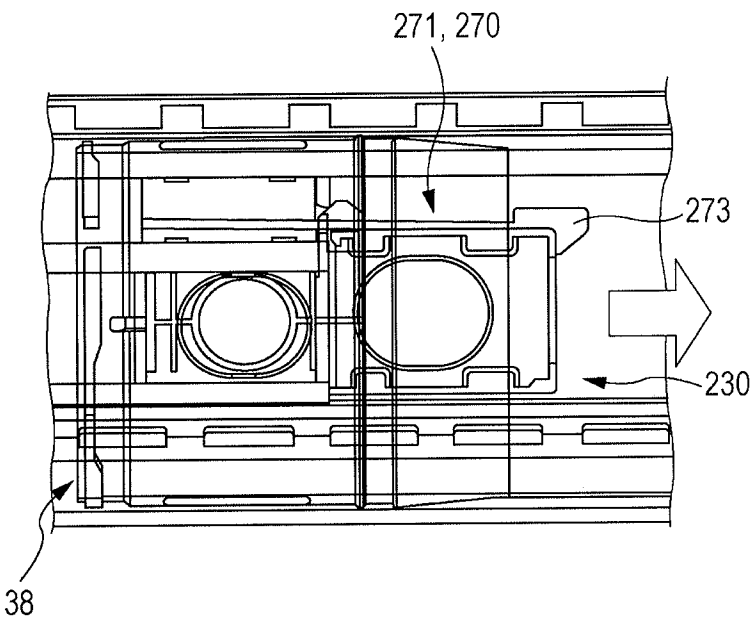

FIG. 22 illustrates the functional part provided on the container receiver 100 to perform the opening-closing operation of the shutter 230. FIGS. 23A, 23B, 24A and 24B are diagrams illustrating a shutter opening operation performed by the functional part provided on the container receiver 100. FIGS. 25A and 25B illustrate a shutter closing operation performed by the functional part.

Figure 23B:
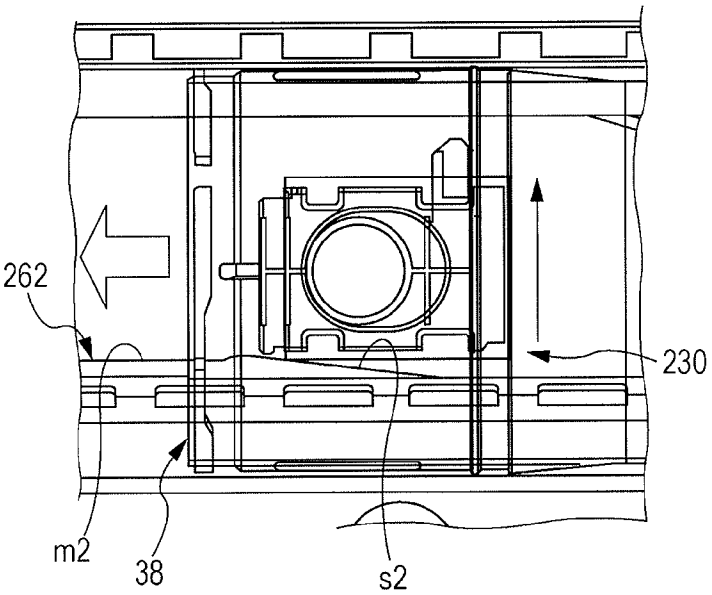
FIGS. 23A and 23B illustrate the manner in which the state of the shutter is changed from the closed state to the locked state in a shutter opening operation performed by the functional part provided on the container receiver.
Figure 23A:
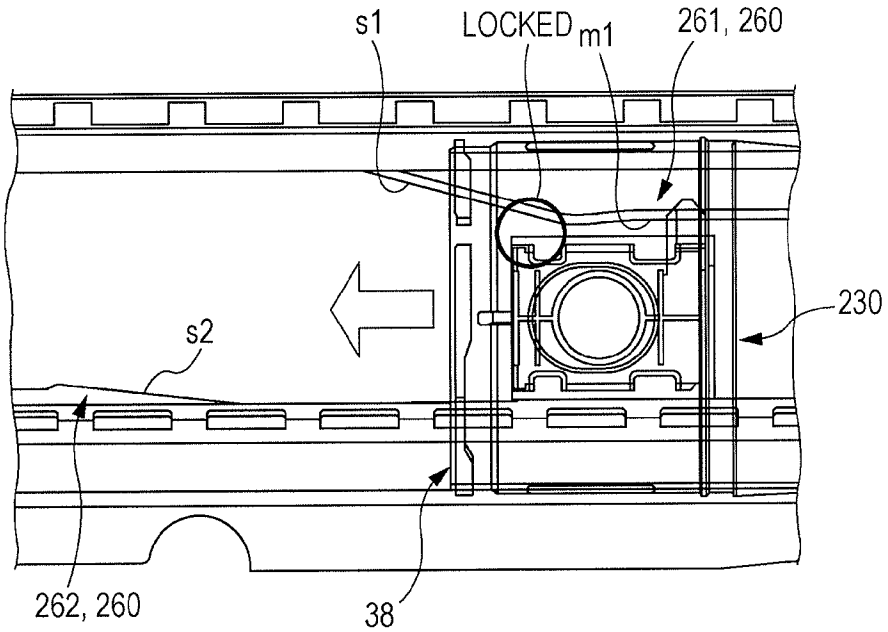

FIGS. 23A and 23B illustrate the manner in which the state of the shutter 230 is changed from the closed state illustrated in FIG. 23A to the locked state illustrated in FIG. 23B. FIGS. 24A and 24B illustrate the manner in which the state of the shutter 230 is changed from the unlocked state illustrated in FIG. 24A to the open state illustrated in FIG. 24B.

In the present exemplary embodiment, the container receiver 100 includes lid guide rails 260 and a lid moving-and-retaining mechanism 270. The lid guide rails 260 guide the opening-closing lid 240 of the toner cartridge 38 along the moving trajectory thereof. The lid moving-and-retaining mechanism 270 comes into contact with the opening-closing lid 240 when the toner cartridge 38 is inserted and retains the opening-closing lid 240 after the opening-closing lid 240 is moved to the open position. The lid moving-and-retaining mechanism 270 also moves the opening-closing lid 240 from the open position to the closed position when the toner cartridge 38 is extracted.

The toner cartridge 38 includes the releasing projection 281 (see, for example, FIG. 15A) as a lid releasing mechanism 280 that releases the opening-closing lid 240 from a retained state, in which the opening-closing lid 240 is retained by the lid moving-and-retaining mechanism 270, when the opening-closing lid 240 reaches the closed position while the toner cartridge 38 is being extracted.

Lid Guide Rails

The lid guide rails 260 include, for example, a first lid guide rail 261 and a second lid guide rail 262. The first lid guide rail 261 includes a first guide surface m1 that regulates the positions of the side wall portions 242 at both sides of the opening-closing lid 240 in the width direction thereof when the shutter 230 is at the closed position. The regulation by the first guide surface m1 is eliminated at an intermediate position of the first lid guide rail 261. The second lid guide rail 262 is disposed behind the first lid guide rail 261, and includes a second guide surface m2 which moves the shutter 230 from a locked position to an unlocking position, as illustrated in FIGS. 23A, 23B, 24A and 24B.

In the present exemplary embodiment, the first lid guide rail 261 includes a guiding surface s1 which extends from the terminal end of the first guide surface m1 and is inclined outward. The second lid guide rail 262 includes a guiding surface s2 which extends to the second guide surface m2 from a position which the opening-closing lid 240 of the shutter 230 reaches after the regulation by the first guide surface m1 is completely eliminated. The guiding surface s2 is inclined in substantially the same direction as the direction in which the guiding surface s1 is inclined.

Lid Moving-and-Retaining Mechanism

In the present exemplary embodiment, the elastic retainer 271 is provided as an example of the lid moving-and-retaining mechanism 270. The elastic retainer 271 is a retaining member that extends in the opening-closing direction of the opening-closing lid 240 and that is elastically deformable. The elastic retainer 271 includes an elastic plate 272 that is elastically deformable and a hook-shaped retaining projection 273 provided integrally with the elastic plate 272 at an end thereof. A guiding portion 274 is provided at an end of the retaining projection 273. The guiding portion 274 is inclined such that the guiding portion 274 is elastically deformed outward when the opening-closing lid 240 comes into contact therewith.

When the toner cartridge 38 is inserted, the elastic retainer 271 having the above-described structure comes into contact with the opening-closing lid 240 and moves the opening-closing lid 240 to the open position. When the opening-closing lid 240 reaches the open position, the elastic retainer 271 is elastically deformed in a direction away from the opening-closing lid 240. Then, the elastic retainer 271 restores from the elastically deformed state and retains the opening-closing lid 240 at the open position. Thus, the elastic retainer 271 corresponds to an example of a lid holder that holds the opening-closing lid 240 at the open position. In the present exemplary embodiment, the elastic retainer 271, which is an example of the lid moving-and-retaining mechanism 270, is provided at one of the opposite sides of the opening-closing lid 240 in the width direction.

Lid Releasing Mechanism

In addition, in the present exemplary embodiment, the releasing projection 281 is provided as an example of the lid releasing mechanism 280 (see, for example, FIGS. 15A, 15B, 25A, and 25B). When the toner cartridge 38 is extracted and the opening-closing lid 240 reaches the closed position, the releasing projection 281 is pushed against the elastic retainer 271, as illustrated in FIGS. 25A and 25B, so that the elastic retainer 271 is elastically deformed in a direction away from the opening-closing lid 240. Thus, the state in which the opening-closing lid 240 is retained by the elastic retainer 271 is canceled by the releasing projection 281.

Insertion-Extraction Operation of Toner Cartridge

A toner cartridge insertion process and a toner cartridge extraction process will be described in more detail with reference to FIGS. 23A, 23B, 24A, 24B, 25A and 25B. In FIGS. 23A, 23B, 24A, 24B, 25A and 25B, the toner cartridge 38 is drawn in a see-through manner to clarify the positional relationship between the container receiver 100 and the toner cartridge 38.

(1) Toner Cartridge Insertion Process (FIGS. 23A, 23B, 24A and 24B)

When the toner cartridge 38 is inserted into the container receiver 100, the shutter 230 is operated as follows.

That is, the opening-closing lid 240 at the closed position moves while being guided by the lid guide rails 260 (261 and 262), as illustrated in FIGS. 23A, 23B, and 24A. When the opening-closing lid 240 reaches a position in front of the position where the opening-closing lid 240 starts to open (see FIGS. 16, 17A, and 17B), the state of the opening-closing lid 240 is changed to the locked state and then to the unlocked state. Then, the opening-closing lid 240 moves while pushing the elastic retainer 271 outward until the opening-closing lid 240 is retained by the elastic retainer 271. Then, the toner cartridge 38 is inserted while the opening-closing lid 240 is retained by the elastic retainer 271 of the lid moving-and-retaining mechanism 270, so that the opening-closing lid 240 is moved to the open position, as illustrated in FIG. 24B.

During this process, the user simply inserts the toner cartridge 38 along an insertion-extraction direction (which corresponds to the attachment-detachment direction) in which the toner cartridge 38 is inserted into and extracted from the container receiver 100. In particular, in the present exemplary embodiment, since the insertion-extraction direction of the toner cartridge 38 is substantially the same as the opening-closing direction of the shutter 230, it is not necessary to consider the opening-closing operation of the shutter 230. Accordingly, the shutter 230 can be set to the open position simply by inserting the toner cartridge 38 into the container receiver 100. Then, the toner is supplied to the reserve tank 110 through the discharge port 220 in the toner cartridge 38.

(2) Toner Cartridge Extraction Process (FIGS. 25A and 25B)

When the toner cartridge 38 is extracted from the container receiver 100, the shutter 230 is operated as follows.

That is, as illustrated in FIGS. 25A and 25B, the opening-closing lid 240 is moved to the closed position by the elastic retainer 271, and then the state in which the opening-closing lid 240 is retained by the elastic retainer 271 is canceled by the releasing projection 281. Then, the toner cartridge 38 is extracted from the container receiver 100 while the shutter 230 is at the closed position.

Inclination of Opening-Closing Lid

If, for example, the image forming apparatus 20 vibrates while the toner cartridge 38 is attached to the container receiver 100, there is a possibility that the toner cartridge 38 will move in the container receiver 100 and the opening-closing lid 240 will be inclined. The inclination of the opening-closing lid 240 will now be described in detail.

Figure 26:
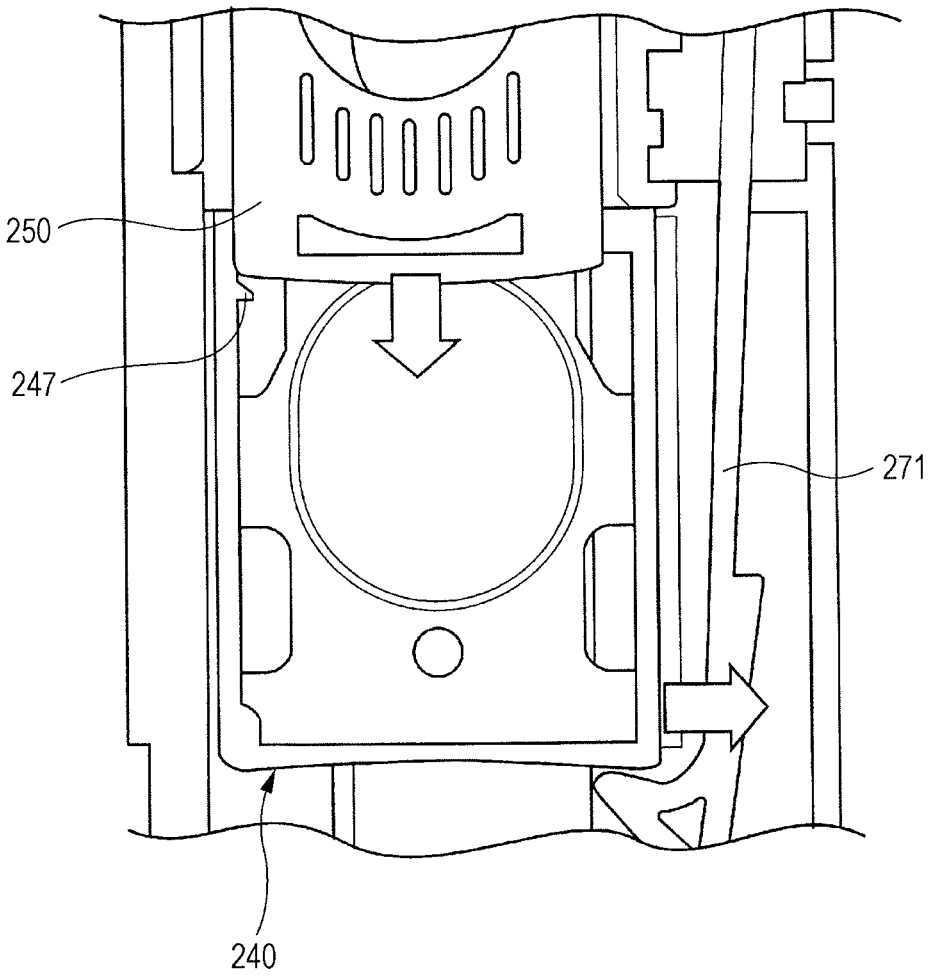
FIG. 26 illustrates the manner in which stress is applied to the opening-closing lid in response to a movement of the toner cartridge.

FIG. 26 illustrates the manner in which stress is applied to the opening-closing lid 240 in response to a movement of the toner cartridge 38.

FIG. 26 illustrates the opening-closing lid 240 that is viewed from the toner cartridge 38, the opening-closing lid 240 being retained by the elastic retainer 271. FIG. 26 also illustrates the lid-retaining frame 250 that is viewed from the toner cartridge 38, the lid-retaining frame 250 being fixed to the toner cartridge 38 and moved together with the toner cartridge 38.

When the toner cartridge 38 is moved in the extraction direction (downward in FIG. 26) in response to, for example, vibration of the image forming apparatus 20, the lid-retaining frame 250 also moves in the extraction direction together with the toner cartridge 38. At this time, a corner portion of the lid-retaining frame 250 comes into contact with the restraining projection 247 on the opening-closing lid 240. As a result, the opening-closing lid 240 may receive a twisting force such that the front portion of the opening-closing lid 240 in the extraction direction of the toner cartridge 38 is pushed against the elastic retainer 271. The twisting of the opening-closing lid 240 is emphasized since the elastic retainer 271 is provided at one of the opposite sides of the opening-closing lid 240 in the width direction. In addition, when the sealing member 255 (see FIG. 10) of the lid-retaining frame 250 pushes one end of the opening-closing lid 240 toward the side that is not viewable in FIG. 26, there is a possibility that the opening-closing lid 240 will be inclined such that the front side of the opening-closing lid 240 in the extraction direction of the toner cartridge 38 is raised toward the side that is viewable in FIG. 26. If the inclination of the opening-closing lid 240 is not corrected, there is a risk that the opening-closing lid 240 will override the elastic retainer 271 in the worst case, owing to the inclination and the above-described twisting of the opening-closing lid 240. However, in the present exemplary embodiment, the inclination of the opening-closing lid 240 can be corrected by the above-described rib 245 on the opening-closing lid 240, as described below.

Figure 27:
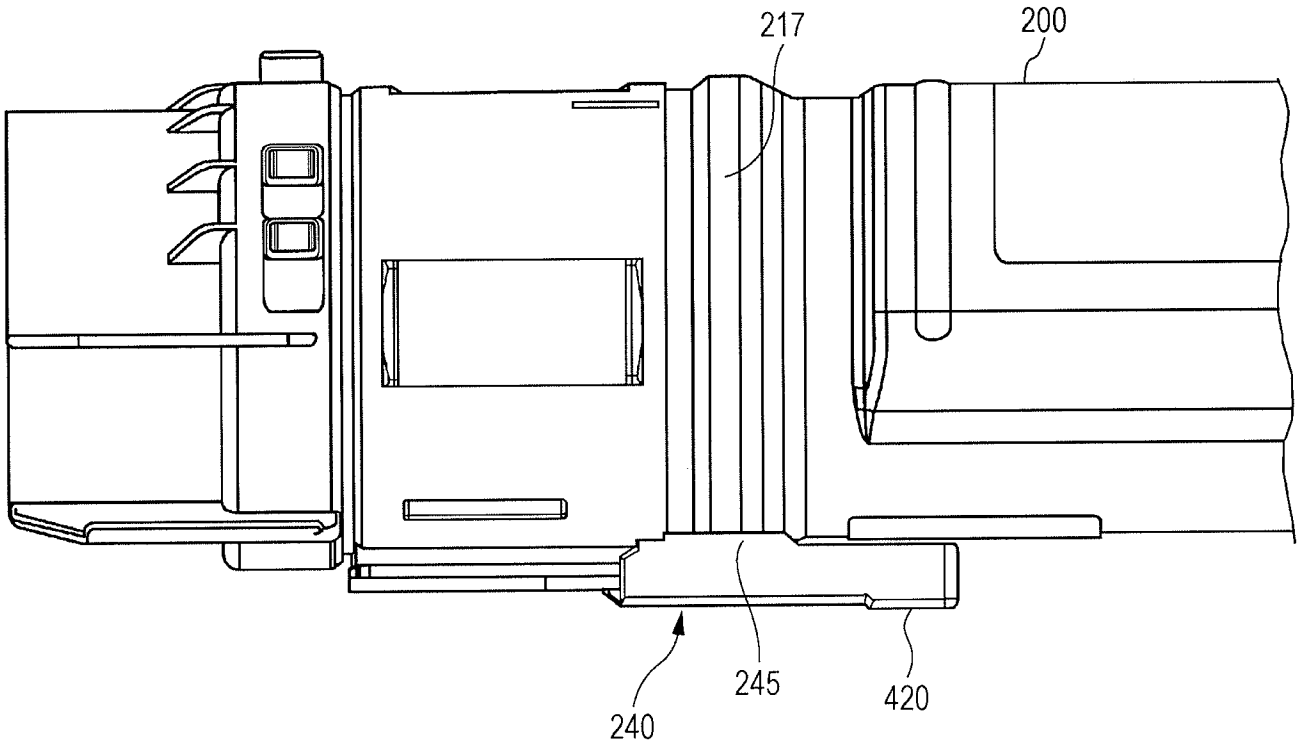
FIG. 27 is a side view illustrating the shape of the opening-closing lid.
Figure 28:
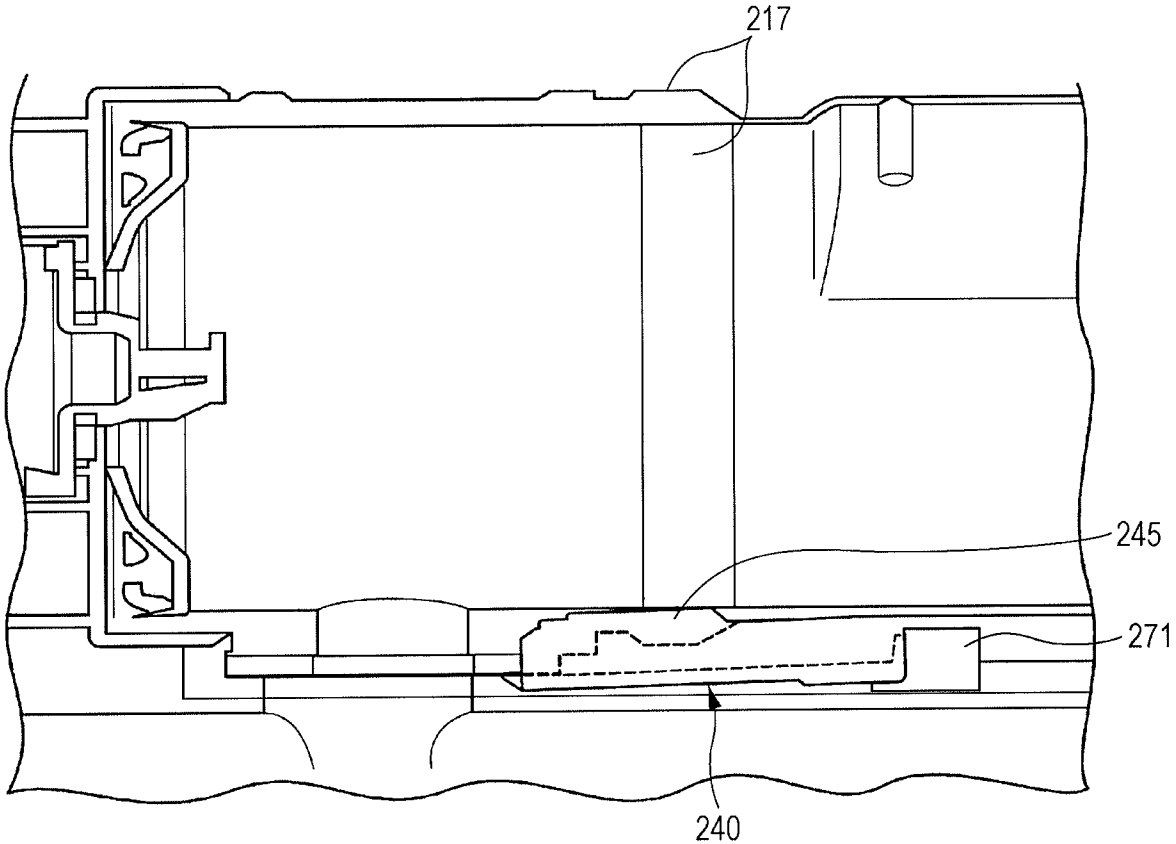
FIG. 28 is a diagram illustrating the manner in which the opening-closing lid is inclined.
Figure 29:
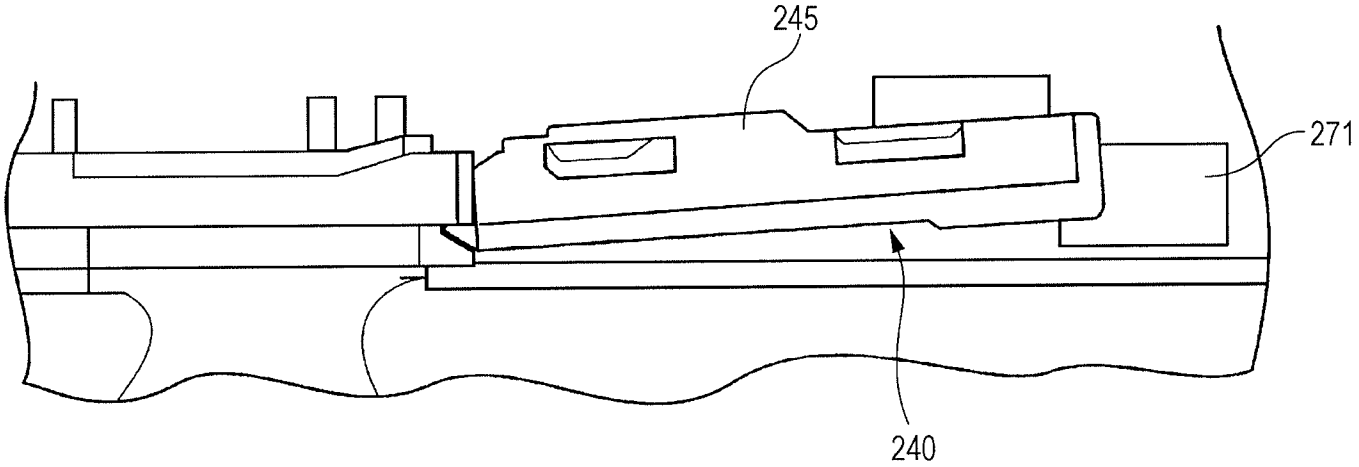
FIG. 29 is an enlarged view illustrating the manner in which the opening-closing lid is inclined.

FIG. 27 is a side view illustrating the shape of the opening-closing lid 240. FIGS. 28 and 29 illustrate the state in which the opening-closing lid 240 is inclined. FIG. 28 illustrates the positions of the opening-closing lid 240 and the protruding portion 217 of the toner cartridge 38, and FIG. 29 is an enlarged view of an area around the opening-closing lid 240.

The opening-closing lid 240 includes the above-described rib 245 and the step portion 420. The step portion 420 suppresses rattling of the opening-closing lid 240, and thereby reduces the occurrence of inclination of the opening-closing lid 240. The range in which the step portion 420 is formed is preferably about one-fourth the entire length of the opening-closing lid 240. If the range in which the step portion 420 is formed exceeds about half the entire length of the opening-closing lid 240, the step portion 420 cannot effectively reduce the occurrence of inclination.

When the opening-closing lid 240 is inclined, the rib 245 comes into contact with the protruding portion 217 and reduces the inclination. Since the inclination of the opening-closing lid 240 is suppressed by the rib 245, the state in which the opening-closing lid 240 is retained by the elastic retainer 271 is maintained. In other words, the opening-closing lid 240 is prevented from overriding the elastic retainer 271. As a result, the opening-closing lid 240 is reliably closed when the toner cartridge 38 is extracted.

The state of the opening-closing lid 240 illustrated in FIG. 27 is the same as the state of the opening-closing lid 240 illustrated in FIG. 10. In this state, the position of the rib 245 overlaps the position of the protruding portion 217. In the present exemplary embodiment, since the protruding portion 217 is provided, the inclination of the opening-closing lid 240 is suppressed compared to the case in which the protruding portion 217 is not provided. Accordingly, the opening-closing lid 240 is more reliably closed. If the rib 245 is provided, the inclination of the opening-closing lid 240 is suppressed even when the protruding portion 217 is not provided.

In FIG. 27, the rib 245 and the protruding portion 217 are drawn as if they are already in contact with each other. However, in practice, the protruding portion 217 is curved so that the rib 245 is not in contact with any part of the cylindrical container body 200 when the opening-closing lid 240 is in a horizontal orientation, as illustrated in FIG. 27. In addition, the rib 245 does not come into contact with the cylindrical container body 200 during the opening-closing operation of the opening-closing lid 240. In other words, the height of the rib 245 is set such that the rib 245 does not come into contact with the cylindrical container body 200 when the opening-closing lid 240 is not inclined. In addition, in the present exemplary embodiment, the rib 245 is provided on one of the two side wall portions 242 that extend in the opening-closing direction of the opening-closing lid 240 at the side opposite to the side at which the elastic retainer 271 is provided. Since the rib 245 is provided on the side wall portion 242 at this side, it is not necessary to consider the risk that the rib 245 will come into contact with the releasing projection 281 illustrated in, for example, FIGS. 15A, 15B, 25A, and 25B. Accordingly, the height of the rib 245 can be increased compared to that in the case in which the rib 245 is provided on the side wall portion 242 at the side at which the elastic retainer 271 is provided. As a result, the inclination of the opening-closing lid 240 can be further suppressed and the closing operation of the opening-closing lid 240 can be more reliably performed.

Unlike the above-described exemplary embodiment, in a comparative example in which no rib is provided, the inclination of the opening-closing lid cannot be suppressed.

Figure 30:
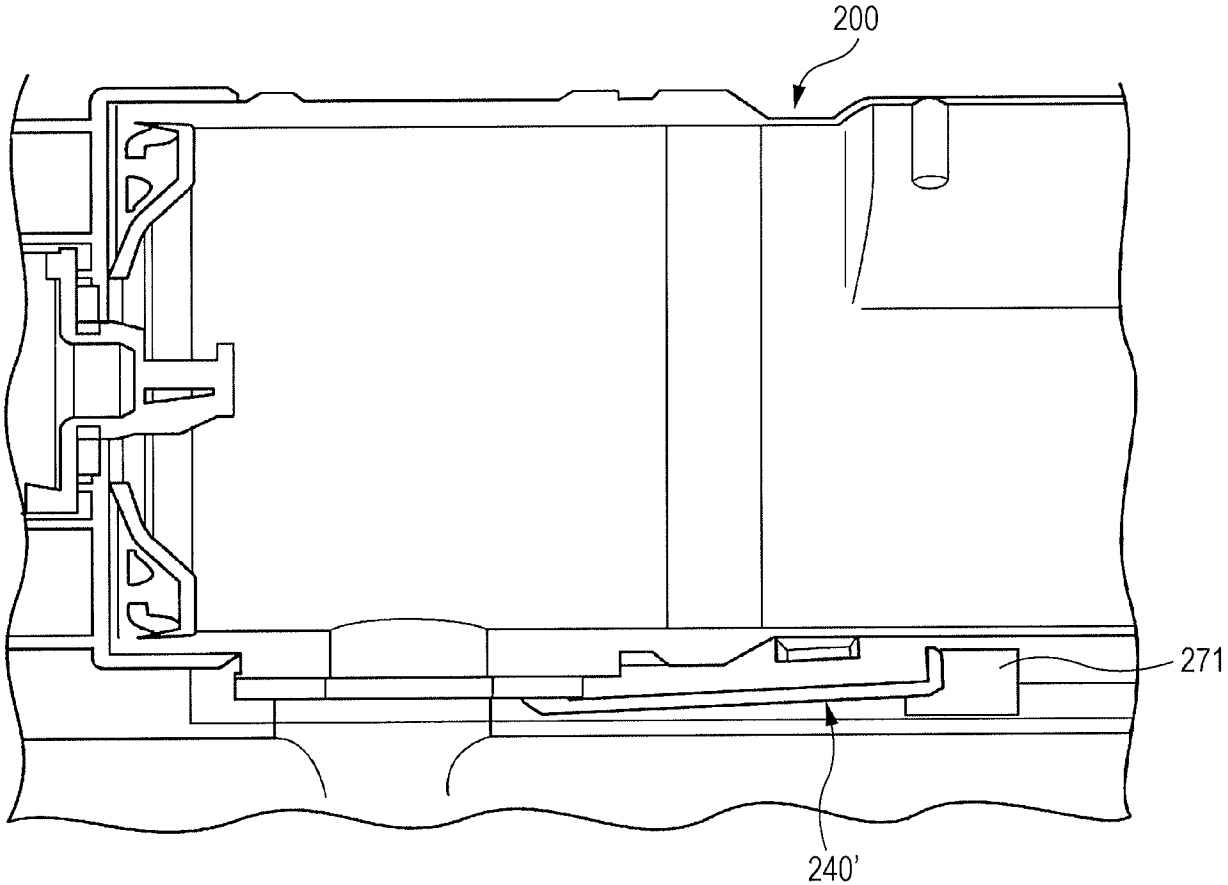
FIG. 30 illustrates the inclination of the opening-closing lid according to a comparative example.

FIG. 30 illustrates the inclination of the opening-closing lid according to a comparative example.

An opening-closing lid 240' according to the comparative example is not provided with the rib according to the present exemplary embodiment. Therefore, the inclination of the opening-closing lid 240' is not suppressed. As a result, there is a risk that the opening-closing lid 240' will be twisted such that the side of the opening-closing lid 240' that is not viewable in FIG. 30 will be raised along the outer wall of the cylindrical container body 200 and override the elastic retainer 271.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder container comprising:

a container body capable of being attached to and detached from a powder processing apparatus that processes powder, the container body including an outer wall that has an opening and extends in an attachment-detachment direction in which the container body is attached or detached, the container body containing the powder before or after the powder is processed;

a lid that covers the opening in the outer wall, the lid being held by a lid holder such that the opening is not covered by the lid when the container body is attached to the powder processing apparatus, the lid holder being provided in the powder processing apparatus;

a retaining frame that projects from the periphery of the opening in the outer wall so as to extend over an area around the opening, the retaining frame retaining the lid such that the lid is movable in the attachment-detachment direction; and a suppressing body that projects from the lid toward the outer wall of the container body by an amount set such that the suppressing body does not come into contact with the outer wall when the lid is moved and such that, if the lid is inclined while being held by the lid holder, the suppressing body comes into contact with the outer wall to suppress the inclination of the lid before the lid is released from the lid holder.

2. The powder container according to claim 1, wherein the container body includes a continuous body that is positioned closer to an extraction end of the container body than the opening in the attachment-detachment direction and that projects outward from the outer wall, the continuous body being continuous on the outer wall in a direction that crosses the attachment-detachment direction.

3. The powder container according to claim 2, wherein the lid includes a plate-shaped plate portion that extends along the outer wall, and a step portion that is provided on a second surface of the plate portion at a side opposite to a first surface of the plate portion that faces the outer wall, the step portion being located at a position near an extraction end of the plate portion in the attachment-detachment direction and having a stepped shape such that the step portion protrudes in a direction away from the outer wall.

4. The powder container according to claim 1, wherein the container body includes a continuous body that is positioned closer to an extraction end of the container body than the opening in the attachment-detachment direction and that projects outward from the outer wall, the continuous body being continuous on the outer wall in a direction that crosses the attachment-detachment direction, wherein the lid includes a plate-shaped plate portion that extends along the outer wall, a pair of sandwiching portions that project toward the outer wall from the plate portion and extend in the attachment-detachment direction, the sandwiching portions sandwiching the retaining frame in a direction that crosses the attachment-detachment direction, and a regulating portion that projects toward the retaining frame at an intermediate position of at least one of the sandwiching portions that extend in the attachment-detachment direction, the regulating portion regulating a movement of the lid toward the retaining frame, wherein the suppressing body projects toward the outer wall from at least one of the pair of sandwiching portions and extends along the sandwiching portions, and wherein, when a position of an extraction end portion of the retaining frame in the attachment-detachment direction overlaps a position of the regulating portion of the lid in the attachment-detachment direction, a position of the suppressing body overlaps a position of the continuous body in a direction of projection onto the outer wall.

5. The powder container according to claim 4, wherein the lid further includes a step portion that is provided on a second surface of the plate portion at a side opposite to a first surface of the plate portion that faces the outer wall, the step portion being located at a position near an extraction end of the plate portion in the attachment-detachment direction and having a stepped shape such that the step portion protrudes in a direction away from the outer wall.

6. The powder container according to claim 1, wherein the lid includes a plate-shaped plate portion that extends along the outer wall, and a step portion that is provided on a second surface of the plate portion at a side opposite to a first surface of the plate portion that faces the outer wall, the step portion being located at a position near an extraction end of the plate portion in the attachment-detachment direction and having a stepped shape such that the step portion protrudes in a direction away from the outer wall.

7. A powder processing apparatus comprising:

a powder container that contains the powder; and a container receiver to which the powder container is detachably attached, wherein the powder container includes a container body capable of being attached to and detached from the container receiver, the container body including an outer wall that has an opening and extends in an attachment-detachment direction in which the container body is attached or detached, the container body containing the powder, a lid that covers the opening in the outer wall, the lid being moved along the attachment-detachment direction to open the opening when the container body is attached to the container receiver portion, and a retaining frame that projects from the periphery of the opening in the outer wall so as to extend over an area around the opening, the retaining frame retaining the lid such that the lid is movable in the attachment-detachment direction, wherein the container receiver includes a lid holder that holds the lid at a position where the opening is not covered by the lid when the powder container is attached to the container receiver, and wherein the powder container further includes a suppressing body that projects from the lid toward the outer wall of the container body by an amount set such that the suppressing body does not come into contact with the outer wall when the lid is moved and such that, if the lid is inclined while being held by the lid holder, the suppressing body comes into contact with the outer wall to suppress the inclination of the lid before the lid is released from the lid holder.

8. The powder processing apparatus according to claim 7, wherein the lid includes a plate-shaped plate portion that extends along the outer wall, and a pair of sandwiching portions that project toward the outer wall from the plate portion and extend in the attachment-detachment direction, the sandwiching portions sandwiching the retaining frame in a direction that crosses the attachment-detachment direction, wherein the lid holder is provided on one of the pair of sandwiching portions, and wherein the suppressing body projects toward the outer wall from the other one of the sandwiching portions.

* * * * *